US010590565B2

(12) United States Patent
Huang et al.

(10) Patent No.: US 10,590,565 B2
(45) Date of Patent: Mar. 17, 2020

(54) POLYMERIC NANOFIBERS AND NANOFIBROUS WEB

(71) Applicant: DUPONT SAFETY & CONSTRUCTION, INC., Wilmington, DE (US)

(72) Inventors: Tao Huang, Downingtown, PA (US); Thomas Patrick Daly, Aston, PA (US); Zachary R Dilworth, Wilmington, DE (US)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 0 days.

(21) Appl. No.: 16/264,809

(22) Filed: Feb. 1, 2019

(65) Prior Publication Data

US 2019/0161889 A1 May 30, 2019

Related U.S. Application Data

(62) Division of application No. 14/520,645, filed on Oct. 22, 2014, now Pat. No. 10,233,568.

(60) Provisional application No. 61/893,958, filed on Oct. 22, 2013.

(51) Int. Cl.

| | |
|---|---|
| ***B01D 5/00*** | (2006.01) |
| ***D01D 4/02*** | (2006.01) |
| ***D01F 6/00*** | (2006.01) |
| ***D01D 5/18*** | (2006.01) |

(52) U.S. Cl.

CPC ..... *D01D 4/025* (2013.01); *D01D 5/18* (2013.01); *D01F 6/00* (2013.01); *Y10T 428/298* (2015.01); *Y10T 442/60* (2015.04)

(58) Field of Classification Search

CPC ..... B29C 41/24; D04H 1/56; D04H 13/001; D01D 4/025; D01D 6/00

See application file for complete search history.

(56) References Cited

U.S. PATENT DOCUMENTS

| | | | |
|---|---|---|---|
| 2,984,864 | A | 5/1961 | Levecque et al. |
| 3,475,198 | A | 10/1969 | Drum |
| 4,846,643 | A | 7/1989 | Yamaoto |

(Continued)

FOREIGN PATENT DOCUMENTS

| | | |
|---|---|---|
| EP | 0562053 B1 | 10/1996 |
| RU | 2093618 C1 | 10/1997 |

(Continued)

OTHER PUBLICATIONS

Van Der Wal, A. et al., Fracture of polypropylene: 2. The effect of crystalinity, Polymer, 1998, pp. 5477-5481, vol. 39, No. 22.

(Continued)

*Primary Examiner* — Joseph S Del Sole
*Assistant Examiner* — Thu Khanh T Nguyen

(57) ABSTRACT

The present invention is directed toward an apparatus comprising a high speed rotating disk or bowl for nanofiber spinning from the rotational sheared thin film fibrillation at the enclosed serrations with the optimized stretching zone to produce the defects-free nanofibrous web and nanofibrous membrane comprising a nanofiber network with a number average nanofiber diameter less than 500 nm that yield the crystallinity higher than the polymer resin used in making the web.

1 Claim, 26 Drawing Sheets

(56) References Cited

U.S. PATENT DOCUMENTS

| | | | | |
|---|---|---|---|---|
| 5,018,954 | A | 5/1991 | Jergenson | |
| 7,003,987 | B2 | 2/2006 | Skarzenski | |
| 8,231,378 | B2 | 7/2012 | Lozano et al. | |
| 8,277,711 | B2 | 10/2012 | Huang et al. | |
| 8,512,612 | B2 * | 8/2013 | Kook | B01D 67/002 264/175 |
| 9,004,893 | B2 | 4/2015 | Bond et al. | |
| 2007/0090551 | A1 | 4/2007 | Shrader | |
| 2007/0196401 | A1 * | 8/2007 | Naruse | A61K 8/027 424/401 |

FOREIGN PATENT DOCUMENTS

| | | | |
|---|---|---|---|
| WO | 2007/126674 | A1 | 11/2007 |
| WO | 2009/079523 | A3 | 6/2009 |
| WO | 2010/105352 | A1 | 9/2010 |
| WO | 2013/096672 | A1 | 6/2013 |

OTHER PUBLICATIONS

Matar, Omar K., et al., The Flow of Thin Liquid Films Over Spinning Discs, The Canadian Journal of Chemical Engineering, Dec. 2006, pp. 625-642, vol. 84.

PCT Search Report and Written Opinion for International application No. PCT/US2014/061737 dated Jan. 26, 2015.

* cited by examiner

POLYMERIC NANOFIBERS AND NANOFIBROUS WEB

This application is a divisional application of U.S. Ser. No. 14/520,645, filed Oct. 22, 2014, which has now issued as U.S. Pat. No. 10,233,568, and claims the benefit of U.S. Provisional Application No. 61/893,958 filed Oct. 22, 2013.

FIELD OF THE INVENTION

This invention relates to an improved centrifugal nanofiber spinning apparatus for producing the defects-free nanofibrous web and nanofibrous membrane comprising a nanofiber network with a number average nanofiber diameter less than 1000 nm.

BACKGROUND

Polymer nanofibers can be produced from solution-based electrospinning or electroblowing, however, they have very high processing cost, limited throughputs and low productivity. Melt blowing nanofiber processes that randomly lay down fibers do not provide adequate uniformity at sufficiently high throughputs for most end use applications. The resulting nanofibers are often laid on substrate layer of coarse fiber nonwoven or microfiber nonwoven to construct multiple layers. A problem with melt-blown nanofibers or small microfibers, exposed on the top of the web, they are very fragile and easily crushed by normal handling or contact with some object. Also, the multilayer nature of such webs increases their thickness and weight, and also introduces some complexity in manufacture. Centrifugal spun nanofiber process has demonstrated lower manufacturing cost in massive nanoweb production.

U.S. Pat. No. 8,277,711 B2 to DuPont discloses a nozzleless centrifugal melt spin process through rotational thin film fibrillation. The nanofibers with number average diameter less than about 500 nm have been disclosed and shown in examples spun from polypropylene and polyethylene resins. In practice, the operation window is very narrow for making the uniform nanofibers due to the requirement of uniform and smooth thin film flow on the inner surface of the spinning disk, which requires the right rheological properties of polymer and the right combination of the temperature, the rotating speed and melt feeding rate. Otherwise, there would not be uniform and smooth thin film flow on the inner surface of the spinning disk. Instability of the thin film flow and variation of the thickness in the thin film will cause the formation of larger fibers mixed with the nanofibers. If the disk temperature is too high, the molten state threads might lose elasticity due to the potential thermal degradation and the break down into droplets, resulting in nanofibers that might be mixed with the micro-particles or powders. If the disk temperature is too low, the shock-wave instability in the melt filming flow on the inner surface of spinning disk might cause the moving fronts of the filming flow broken off and throw off from the spinning disk, resulting in the nanofibers might be mixed with the large size defects, such as, the "tadpoles" and the "spatters".

The nanofibers made from the process of U.S. Pat. No. 8,277,711 B2 can be laid on a belt collector to form uniform web media using the process of WO 2013/096672, in which the complicate air flow management needs to be implemented. Otherwise, the uniform web cannot be laid because of the swirling and the twisting of fiber stream due to the "tornado"-like effect under the high speed rotating disk.

U.S. Pat. No. 8,231,378 B2 to University of Texas (later the FibeRio Technology Corporation) discloses a centrifugal nanofiber spinning from rotating spinnerets with nozzles, such as, syringes, micro-mesh pores or non-syringe gaps with a typical openings of diameter sizes of 0.01-0.80 mm. The microfibers with the number average diameter of one micron or larger and the nanofibers have been shown. The nanofiber with number average diameter less than about 300 nm has been disclosed. In general, the centrifugal spinning through nozzles has much less throughput due to the capillary flow through the nozzle orifices and the melt die swell at the nozzle exit. For the current state of the art, the only very low basis weight of the thin layer nanofibers can be deposited on scrim when the polypropylene nanofiber spun from melt. The PP web has very low strength and difficult to handle without scrim.

What is needed is the improvement of centrifugal melt spun nanofiber process of U.S. Pat. No. 8,277,711 B2 to make the nanofibrous web in a much broad operation window, as well as, to address the potential thermal degradation in centrifugal melt spinning, to address the issues mentioned above and the elimination of the defects.

SUMMARY OF THE INVENTION

The present invention is directed toward a spinning apparatus for making polymeric nanofibers, comprising: (a) a high speed rotating member comprising a spinning disk or a spinning bowl wherein the rotating member has an edge and, optionally, the rotating member can be heated by induction heating; (b) a protecting shield affixed to the edge of the rotating member to form enclosed serrations wherein the protecting shield is positioned on the top of the spinning disk or the bottom of the spinning bowl; (c) a stationary shield on the bottom of the rotating member; and (d) an optional stretching zone.

This invention is further directed toward polymeric nanofibers produced from this spinning apparatus wherein the polymeric nanofibers comprise at least about 99% by number of nanofibers with a number average diameter less than about 500 nm.

This invention is still further directed toward a nanofibrous web produced from these polymeric nanofibers wherein the nanofibrous web has: (a) less than about 5% Mw reduction of the nanofibrous web as compared to the polymer used for making the nanofibrous web; (b) essentially the same thermal weight loss as compared to the polymer used for making the nanofibrous web as measured by TGA; (c) higher crystallinity of the nanofibrous web as compared to the polymer used for making the nanofibrous web; and (d) average web strength of at least about 2.5 N/cm.

BRIEF DESCRIPTION OF THE FIGURES

FIG. 8A shows serrations on the edge of the spin disk. FIG. 8B shows a protection shield for the spin disk. FIG. 8C shows the spin disk edge serrations becoming narrower. FIG. 8D shows the spin disk edge serrations remaining constant. FIG. 8E shows the spin disk edge serrations having sharper endpoints. FIG. 8F shows the spin disk edge serrations becoming deeper.

FIG. 9A shows serrations in the shape of half of a round circle. FIG. 9B shows serrations in the shape of half of an ellipse.

DETAILED DESCRIPTION

Definitions

Figure 1:
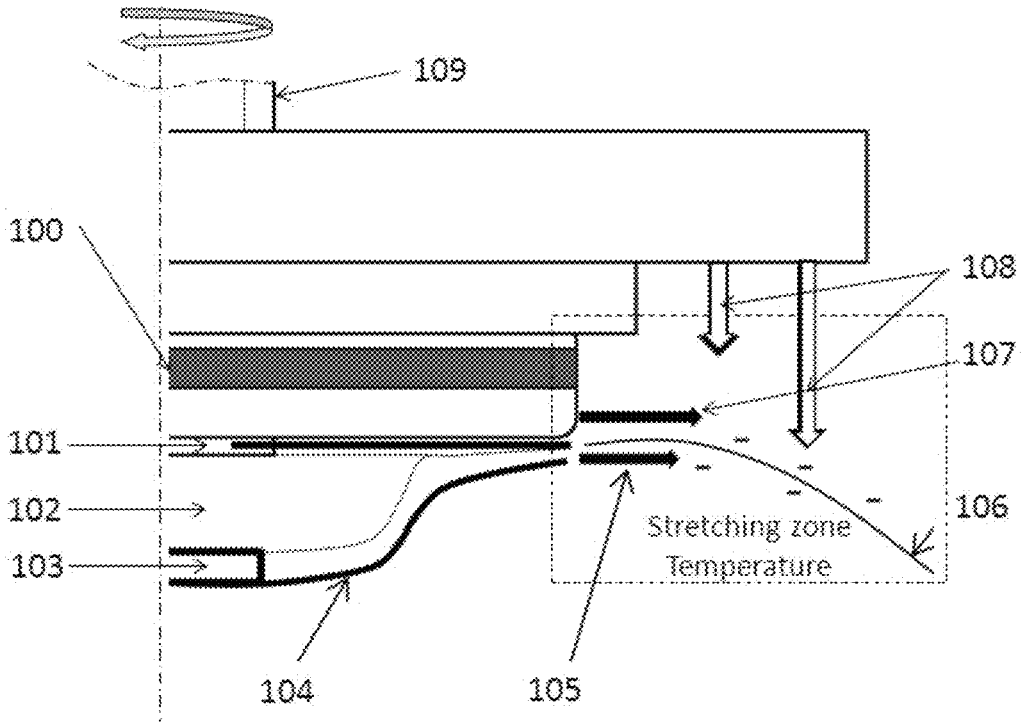
FIG. 1 is an illustration of the apparatus using a spinning disk.

The term "web" as used herein refers to layer of a network of fibers commonly made into a nonwoven.

The term "nonwoven" as used herein refers to a web of a multitude of essentially randomly oriented fibers where no overall repeating structure can be discerned by the naked eye in the arrangement of fibers. The fibers can be bonded to each other, or can be unbounded and entangled to impart strength and integrity to the web. The fibers can be staple fibers or continuous fibers, and can comprise a single material or a multitude of materials, either as a combination of different fibers or as a combination of similar fibers each comprising of different materials.

The term "nanofibrous web" as used herein refers to a web constructed predominantly of nanofibers. "Predominantly" means that greater than 50% of the fibers in the web are nanofibers.

The term "nanofibers" as used herein refers to fibers having a number average diameter less than about 1000 nm. In the case of non-round cross-sectional nanofibers, the term "diameter" as used herein refers to the greatest cross-sectional dimension.

The term "microfibers" as used herein refers to fibers having a number average diameter from about 1.0 μm to about 3.0 μm The term "coarse fibers" as used herein refers to fibers having a number average diameter greater than about 3.0 μm.

The term "centrifugal spinning process" as used herein refers to any process in which fibers are formed by ejection from a rotating member.

The term "rotating member" as used herein refers to a spinning device that propels or distributes a material from which fibrils or fibers are formed by centrifugal force, whether or not another means such as air is used to aid in such propulsion.

The term "concave" as used herein refers to an inner surface of a rotating member that can be curved in cross-section, such as hemispherical, have the cross-section of an ellipse, a hyperbola, a parabola or can be frustoconical, or the like.

The term "spin disk" as used herein refers to a rotating member that has a disk shape with a concave, frustoconical or flat open inner surface.

The term "spin bowl" as used herein refers to a rotating member that has a bowl shape with a concave or frustoconical open inner surface.

The term "fibril" as used herein refers to an elongated structure that may be formed as a precursor to fine fibers that form when the fibrils are attenuated. Fibrils are formed at a discharge point of the rotating member. The discharge point may be an edge, serrations or an orifice through which fluid is extruded to form fibers.

The term "nozzle-free" as used herein refers to the fibril or fibers that are not from a nozzle-type spinning orifices, or there are no any nozzles on rotating member.

The term "charged" as used herein refers to an object in the process that has a net electric charge, positive or negative polarity, relative to uncharged objects or those objects with no net electric charge.

The term "spinning fluid" as used herein refers to a thermoplastic polymer in either melt or solution form that is able to flow and be formed into fibers.

The term "discharge point" as used herein refers to a location on a spinning member from which fibrils or fibers are ejected. The discharge point may, for example, be an edge, or an orifice through which fibrils are extruded.

The term "serration" as used herein refers to a saw-like appearance or a row of sharp or tooth-like projections. A serrated cutting edge has many small points of contact with the material being cut.

The term "micro-particles and the powders" as used herein refers to the particles formed from the molten droplets due to the break-up of the threads.

The term "tadpoles" as used herein refers to the defect shaped in the form of a tadpole.

The term "spatters" as used herein refers to the defect formed from the molten droplets thrown forcefully in a violent way onto the collector.

The term "web defects" as used herein refers to the defects of micro-particles, the powders, tadpoles, and spatters in the web.

The term "wave-front instability" as used herein refers to the instability of the moving front of the thin film flow on the inner surface of the spinning disk.

Figure 6:
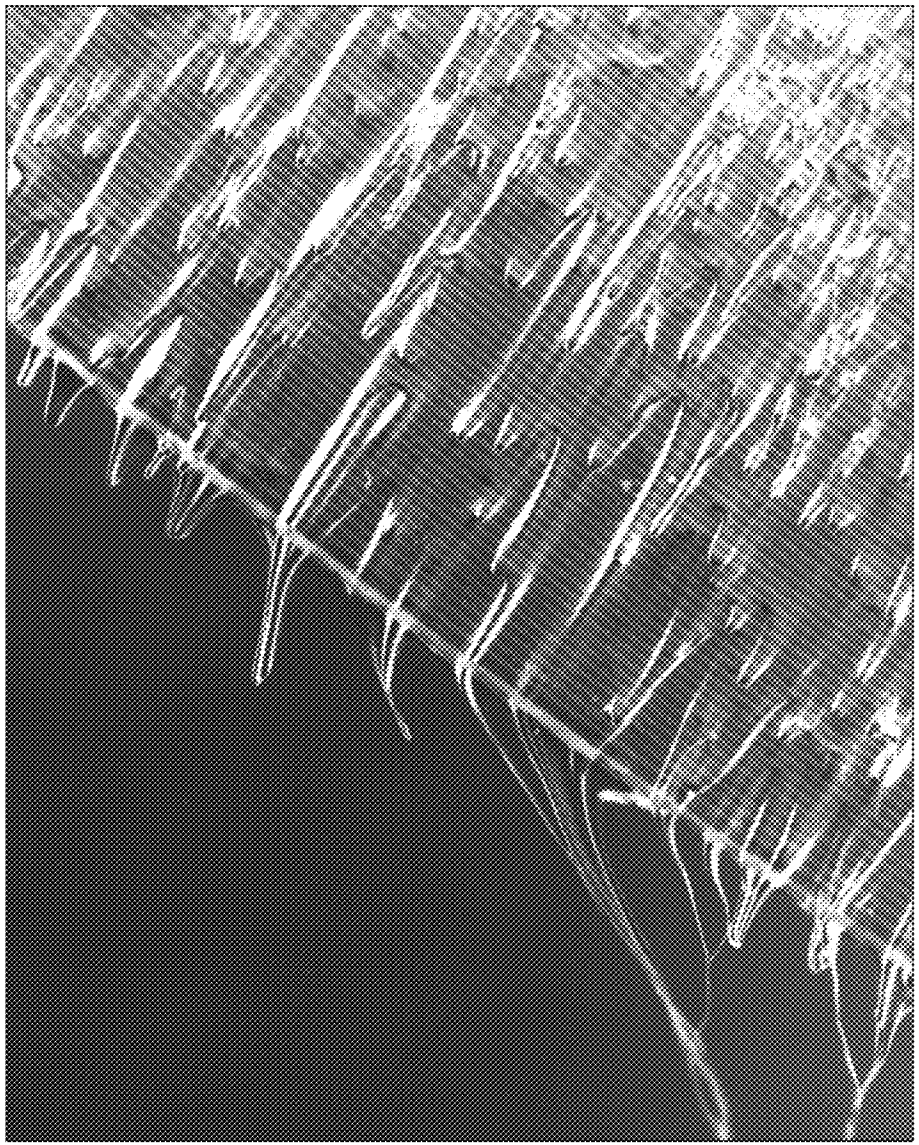
FIG. 6 shows the possible "shock-wave" instability of the thin film on the inner surface of the spin disk and forming the "tadpoles" defect.

The term "Shock-wave instability" as used herein refers to the growth of the perturbation of the moving front of the thin film flow on the inner surface of the spinning disk diminished so significantly that there is little that can be identified as a mixing layer formation for a strong rotation, as shown in FIG. 6.

The term "Rayleigh-Taylor instability" as used herein refers to the instability in fiber formation due to the competition of the centrifugal force and the Laplace force induced by the surface curvature.

The term "Whipping instability" as used herein refers to the bending and whipping movements of the nanofibers driven by the centrifugal force and the aerodynamic force.

The term "tornado-like" as used herein refers to a violently rotating column of fibers that is in contact with both the surface of the collector and a cumulonimbus cloud of the swirling fiber bundles.

The term "essentially" as used herein refers to that if a parameter is held "essentially" at a certain value, then changes in the numerical value that describes the parameter away from that value that do not affect the functioning of the invention are to be considered within the scope of the description of the parameter.

The present invention is directed toward an improved centrifugal nanofiber spinning process of U.S. Pat. No. 8,277,711 B2. The present invention is a melt spinning apparatus, illustrated in FIG. 1 for using a spin disk and FIG. 2 for using a spin bowl, for making a defects-free nanoweb, comprising a high speed rotating disk or bowl with the improvements to the process of U.S. Pat. No. 8,277,711 B2. A nanofiber forming process comprising the steps of: supplying a spinning melt of at least one thermoplastic polymer to an inner spinning surface of a heated rotating disk having a forward surface fiber discharge edge, where the discharge edge has serration on it, issuing the spinning melt along said inner spinning surface so as to distribute the spinning melt into a thin film and toward the forward surface fiber discharge edge, and discharging separate molten polymer fibrous streams from the forward surface discharge edge to attenuate the fibrous streams to produce polymeric nanofibers.

There are four main components in the present invention to improve the process of U.S. Pat. No. 8,277,711 B2 for making the defects-free nanofibrous web and membrane, comprising: (1) a protecting shield, (2) an enclosed serration, (3) a stationary shield, and, optionally, (4) the stretching zone. The protecting shield is on the top of the spinning disk or the bottom of the spinning bowl, as a thermal protecting shield for melt spinning in order to prevent the heating lost to the inner surface of the spinning disk or bowl and as an air protecting shield for solution spinning to prevent the rapidly solvent evaporation from the thin film flow on the inner surface of the spinning disk or bowl. The protecting shield is placed to contact the serrations on the edge of the rotating disk to form enclosed serrations. The enclosed serrations on the edge of the rotating disk suppress the instability of the thin film flow and variation of the thickness at the edge of the spinning disk. As result, the enclosed serrations lead to a fully defect-free pure nanofibers, and eliminates the formation of the microfibers, the coarse fibers and defects. The stationary shield is located on the bottom of the spinning disk or the spinning bowl to protect the further thermal lost, and to prevent the swirling and the twisting of fiber stream due to the "tornado"-like effect under the high speed rotating disk for the uniform web laydown. The stretching zone and maintaining its temperature located surrounding the edge of the rotating disk is designed and implemented to keep the threads in molten state to maximize the stretching or elongation by the centrifugal force. The stretching zone diameter is about 1.5 time of the diameter of the spin disk. The stretching zone temperature is the key element to make the nanofibers.

Figure 2:
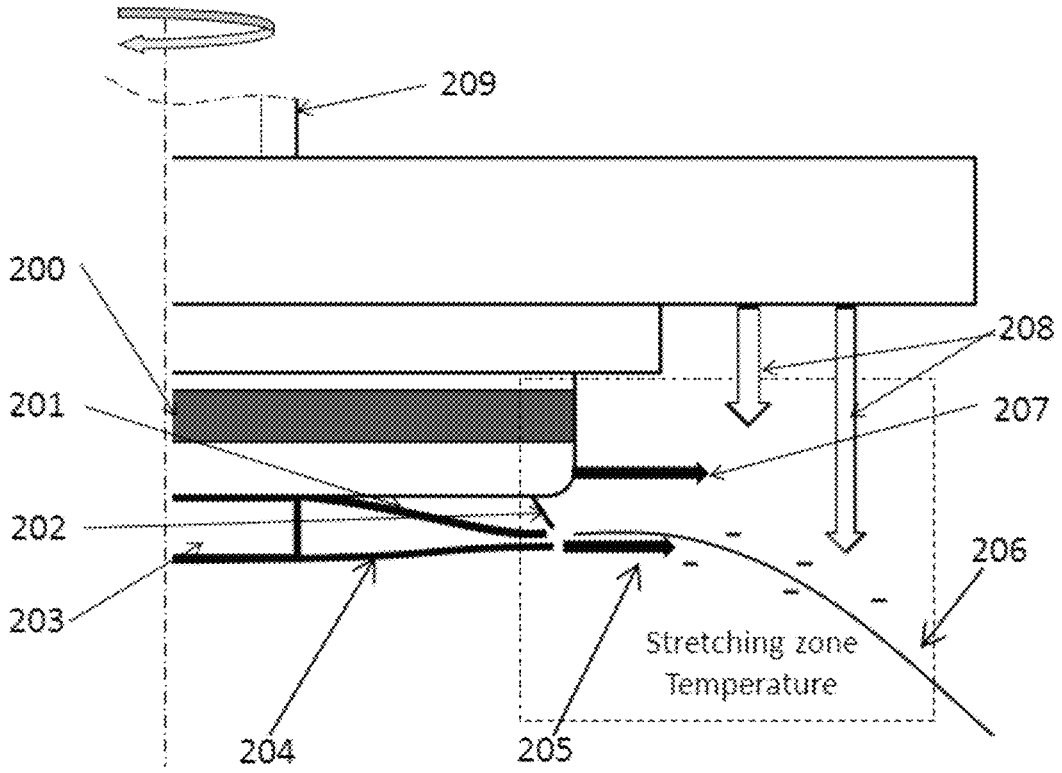
FIG. 2 is an illustration of the apparatus using a spinning bowl.

Considering FIG. 1 for spinning disk 102 or FIG. 2 for spinning bowl 202 mounted on a high speed rotating hollow shaft 109 or 209, fibers 106 or 206 are shown exiting the discharge points at the edge of the spinning disk 102 or at the edge of the spinning bowl 202. A protecting shield 101 or 201 with the same diameter as the spinning disk or the spinning bowl is mounted on top of the spinning disk as a thermal protecting shield for melt spinning in order to prevent the heating lost to the inner surface of the spinning disk and as an air protecting shield for solution spinning to prevent the rapidly solvent evaporation from the thin film flow on the inner surface of the spinning disk.

The protecting shield is placed to contact to the serrations on the edge of the rotating disk to form an enclosed serrations. The enclosed serrations on the edge of the rotating disk suppress the instability of the thin film flow and variation of the thickness at the edge of the spinning disk.

A stationary shield 104 for the spinning disk or 204 for the spinning bowl is mounted on a stationary shaft through the rotating hollow shaft at the bottom of the spinning disk to protect the thermal loss, and to prevent the swirling and the twisting of fiber stream due to the "tornado"-like effect under the high speed rotating disk for the uniform web laydown.

A stretching zone surrounding the edge of the rotating disk is indicated in the dash line rectangle area. The stretching zone temperature is established by the gentle air comes from the combination of three heating air streams. One is from the gentle heating air 107 or 207 above the spinning disk; another is from a stream of gentle heating air 105 or 205 coming from a stationary hot air tube within the rotating hollow shaft 109 or 209, through the gap between the bottom of the spinning disk and the stationary shield to reach the stretching zone; the other gentle heating air is a downward flow 108 or 208. The stretching zone temperature is designed and implemented to keep the threads in molten state to maximize the stretching or elongation by the centrifugal force. The stretching zone diameter is about 1.5 time of the diameter of the spin disk. The stretching zone temperature is the key element to make the nanofibers. For polypropylene in the Example, the stretching zone temperature is optimized around 180° C. by the gentle heating air for the better nanofiber spinning and for the fibers to take electrostatic charging as an option.

The nanofibers are deposited on the surface of a horizontal scrim belt collector or a vertical tubular scrim belt collector using the web laying process of WO 2013/096672, then a roll of the web is wind-up as a stand-alone web roll off from the collection belt. Typically, fibers do not flow in a controlled fashion towards the collector and do not deposit evenly on the collector. The improved process of WO 2013/096672 with the stationary shield under the spinning disk is used in the present invention. The stationary shield prevents the "tornado"-like affect under the high speed rotating disk, therefore, the swirling and the twisting of fiber stream are eliminated in the present invention. A charged ring 100 or 200 is optional with needle assembly or a ring saw with sharp teeth is mounted on the top of stretching zone air heating ring for applying the electrostatic charge to fibrils and fibers 106 being ejected from a spinning disk, or 206 being ejected from a spinning bowl.

Figure 3:
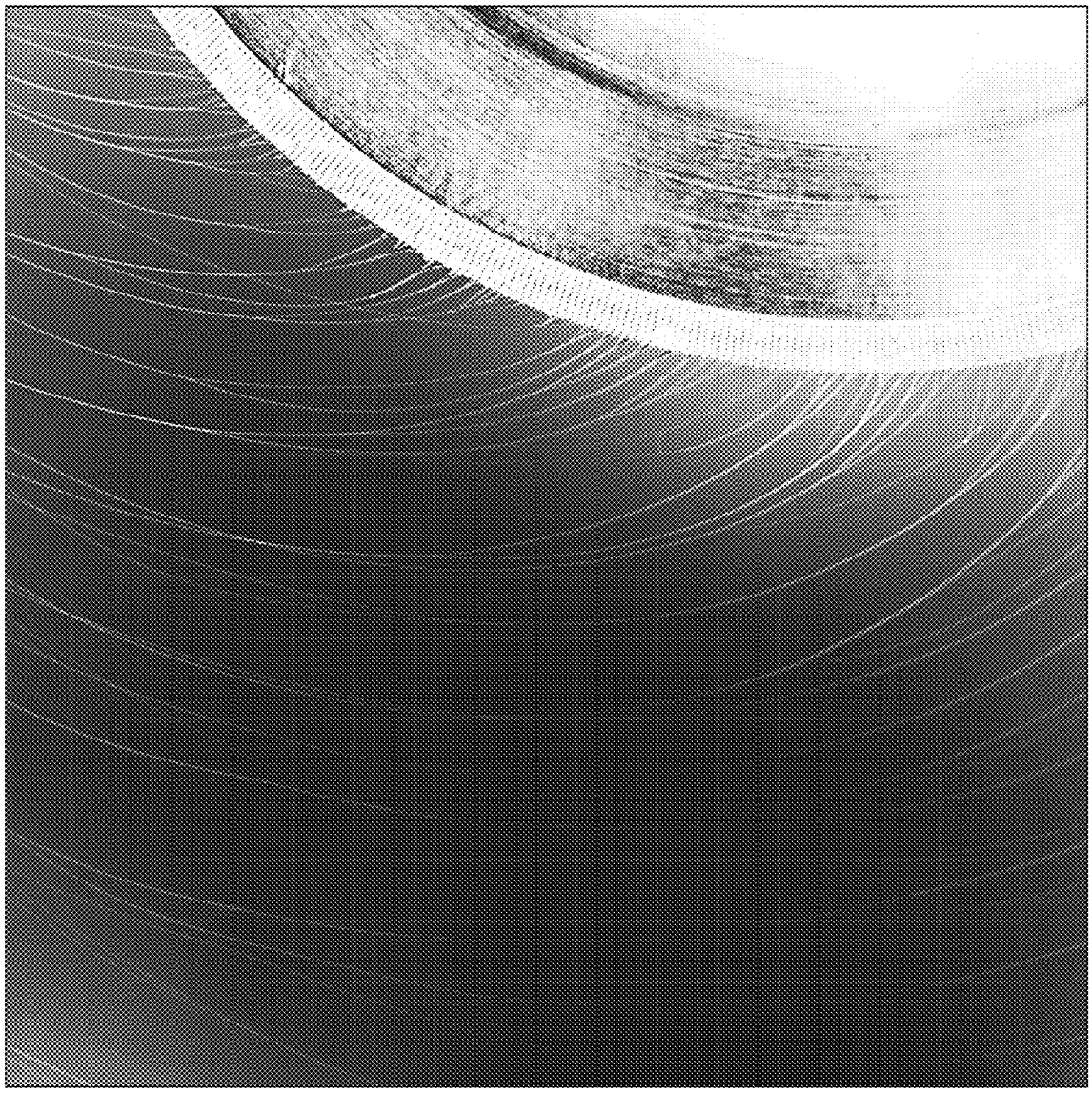
FIG. 3 is a high-speed video image of the uniform stable thin film flow on the inner surface of the spinning disk and the fully pure nanofiber formation.

In practice of U.S. Pat. No. 8,277,711 B2, the fully pure nanofibers can only be made from the uniform and smooth thin film flow on the inner surface of the spinning disk, as shown as the high-speed video image in FIG. 3, which requires the right rheological properties of polymer and the right combination of the temperature, the rotating speed and melt feeding rate. However, the surface of the rotating polymer thin film on the inner surface on the open-end spinning disk would be cooling down due to reaction with the cold air brought in by the high speed rotating. In practice, the heating to the spinning disk would be to the higher temperature in order to have the right melt viscosity and the uniform thin film flow. Therefore, there was a potential thermal degradation if the temperature was set too high. The present invention is about to address this problem. A thermal shield on top of the spinning disk is designed to minimize the reduction of the surface temperature of the rotating polymer thin film. With the thermal shield on top of the spinning disk will lower the disk heating temperature to minimize or to eliminate the thermal degradation.

Figure 4:
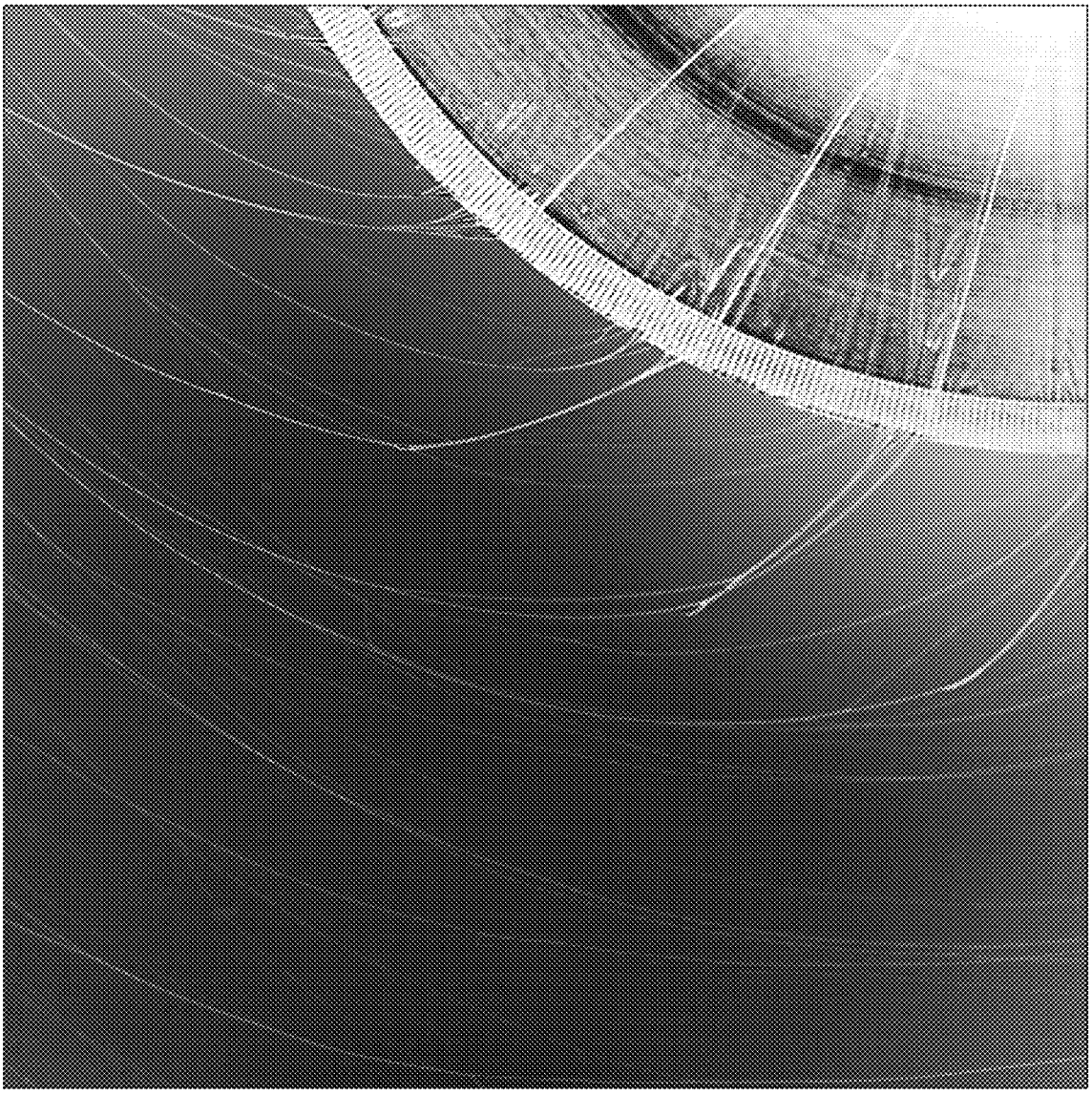
FIG. 4 is a high-speed video image of the unstable thin film flow on the inner surface of the spinning disk and the possible formation of the mixture of nanofibers, microfibers, coarse fibers and defects when spinning out of the operation window.
Figure 5:
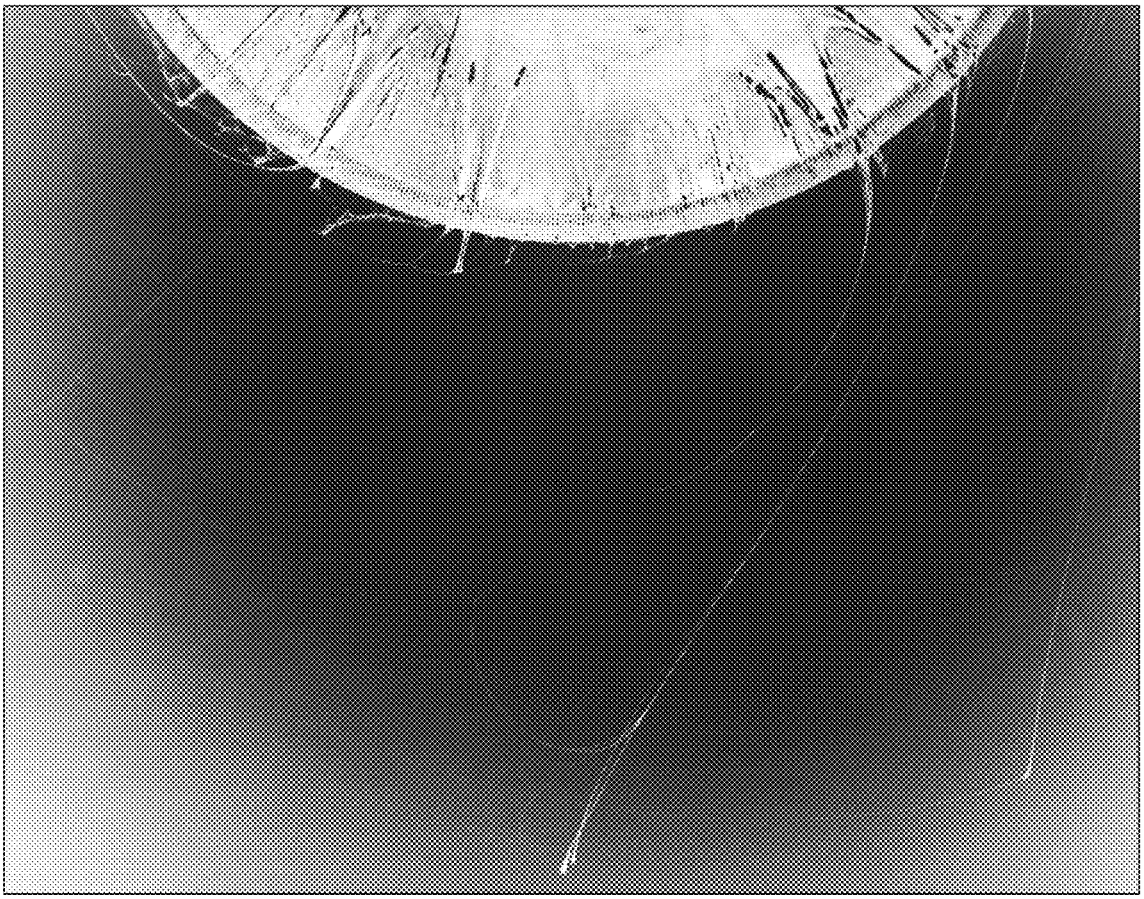
FIG. 5 is a high-speed video image of the unstable thin film flow on the inner surface of the spinning disk when the spinning fluid has high viscosity and the possible formation of the mixture of nanofibers, microfibers, coarse fibers and defects when spinning out of the operation window.
Figure 7A:
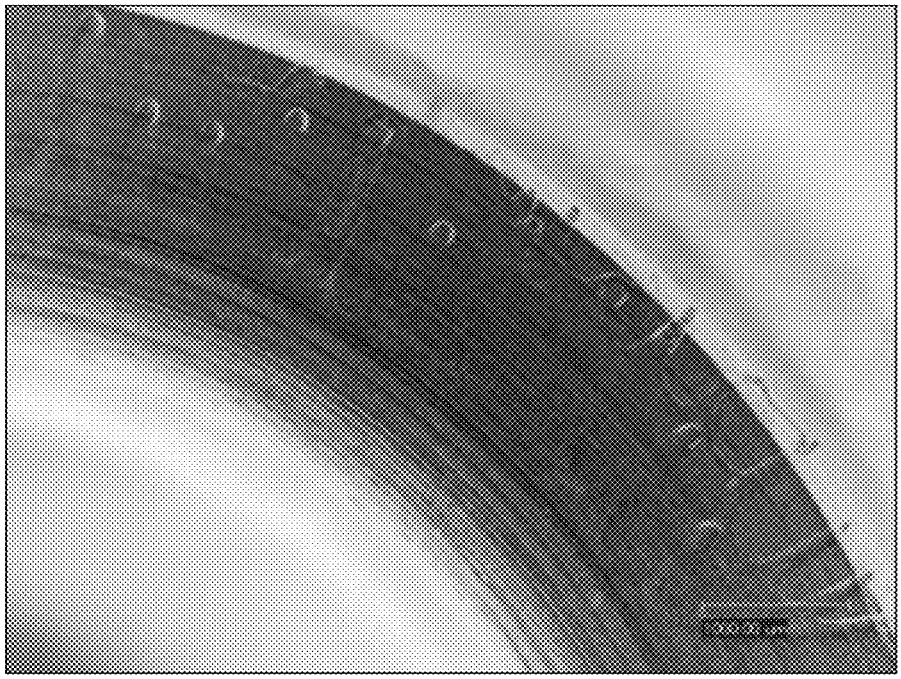
FIG. 7A. shows the possible wave-front instability of the thin film on the inner surface of the spin disk.
Figure 7B:
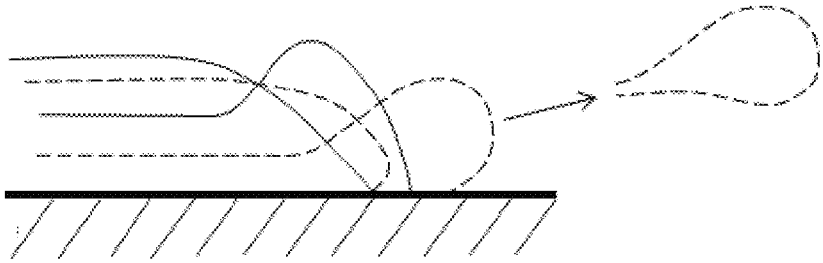
FIG. 7B. illustrates the possible break-up of the wave-front and thrown out from the disk surface as the "spatters" defect.

In practice of U.S. Pat. No. 8,277,711 B2, when the combination of the temperature, the rotating speed and melt feeding rate is not right in the operation window, the thin film flow on the inner surface of the spinning disk will become unstable. The high-speed video image in FIG. 4 shows the large diameter threads will come out and lead to the formation of the microfibers, the coarse fibers. When the polymer viscosity is too high or the temperature of the inner surface of spinning disk or spinning bowl is too low, the thin film flow will not flow and spread well on the inner surface of the spinning disk as shown as in the high-speed video image in FIG. 5. It shows there is no uniform film fibrillation. FIG. 6 shows the shock-wave instability of the thin film flow on the inner surface of the spinning disk. The picture of FIG. 7A and as illustrated in FIG. 7B, shows the possible break-up and thrown-out from the unstable wave fronts of the thin film. As results, the large diameter threads will come out and lead to the formation of the microfibers, the coarse fibers; when the large threads breakdown, the defects, such as the micro-particles, the powders, the "tadpoles" and the "spatters", will be generated.

In the present invention, the edge of the thermal shield is placed to contact to the serrations on the edge of the rotating disk to form an enclosed serrations. The enclosed serrations on the edge of the rotating disk suppress the instability of the thin film flow and variation of the thickness at the edge of the spinning disk.

FIG. 8 illustrates the edge structure of spin disk with serrations on the edge. The spin bowl can have the same or similar structure. The spinning fluid (polymer solution or melt) can be delivered through stationary device, such as, a tube, a transfer line, a transfer ring, or the like, to a reservoir on the center area of the spinning disk. The spinning fluid in the reservoir flows through the side holes on the wall and at the inside bottom of the reservoir to and forms the thin film flow the inner surface of the spinning disk. When the thin film flow reaches the discharging points at the edge of the spinning disk, the thin film breaks into threads or fibrils through film fibrillation. There is an inclining angle, $\alpha$ about 0 to 15 degree, at the edge of the spinning disk. The serrations on the edge of the spinning disk have been shown as 802 in FIG. 8A. In FIG. 8B, the protecting shield 800 covers the inner surface of the spinning disk and touches the serration at the edge of the spinning disk 801. The parameters define the serration structure are the length, L, the depth, D, and the spacing, d, where the ratio of L/D is about 20:1; d/D is about 1:1; with a spacing, d, about in the range of 200 μm to 500 μm.

Figure 8A:
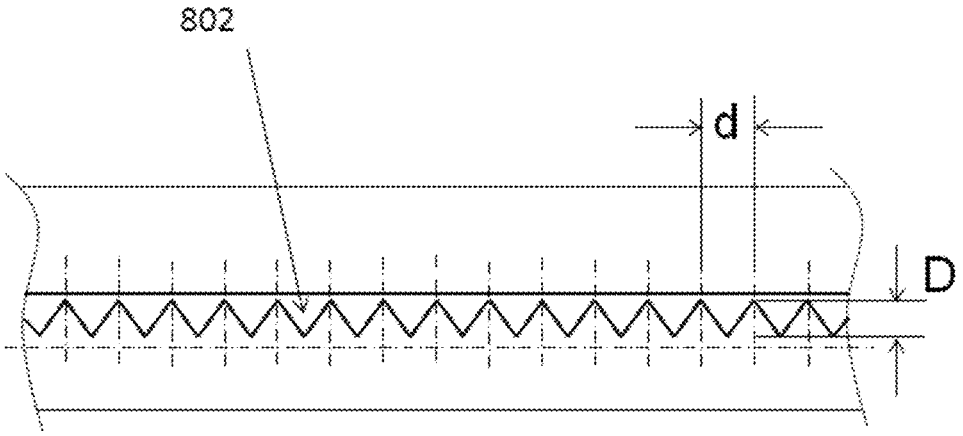
FIGS. 8A-8F are illustrations of the edge of spin disk or spin bowl with the enclosed serrations and the serration structures according to the present invention.
Figure 8B:
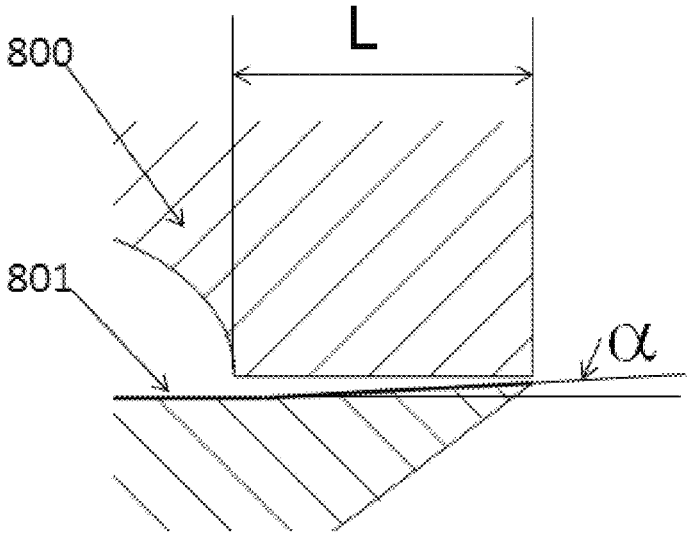
Figure 8C:
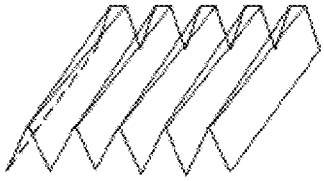
Figure 8D:
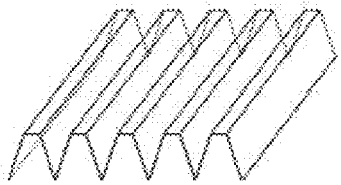
Figure 8E:
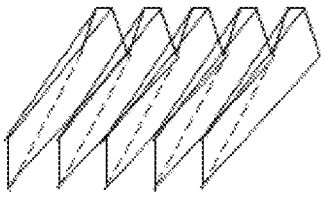
Figure 8F:
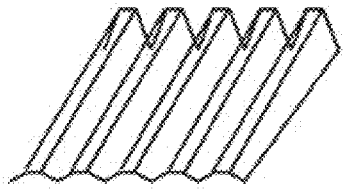

FIGS. 8C-8F also illustrates the structural options of the serrations on the inner surface at the edge of the spinning disk or bowl. FIG. 8C shows the width of the serration gradually becomes narrower for the film into the serration to out of the disk. FIG. 8D shows the width of the serration is constant for the film into the serration to out of the disk. FIG. 8E shows the sharper ends as the film into the serrations and the width of the serration gradually becomes narrower for the film into the serration to out of the disk. FIG. 8F shows that the serrations are smoothly connected to the inner surface of the spinning disk, and the depth of serration gradually becoming deeper.

Figure 9A:
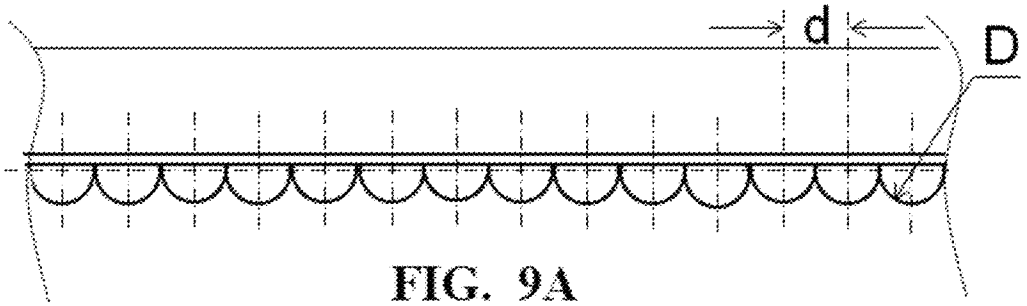
FIGS. 9A and 9B are illustrations of the structure of serrations at the edge of spin disk or spin bowl.
Figure 9B:
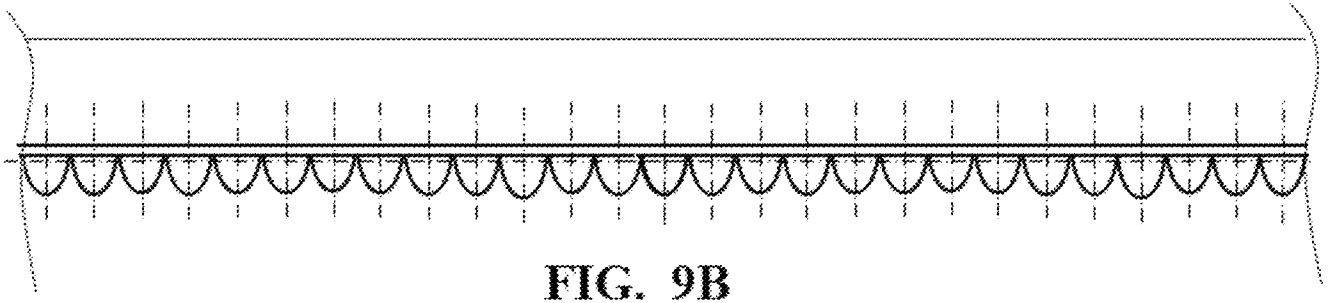
Figure 9C:
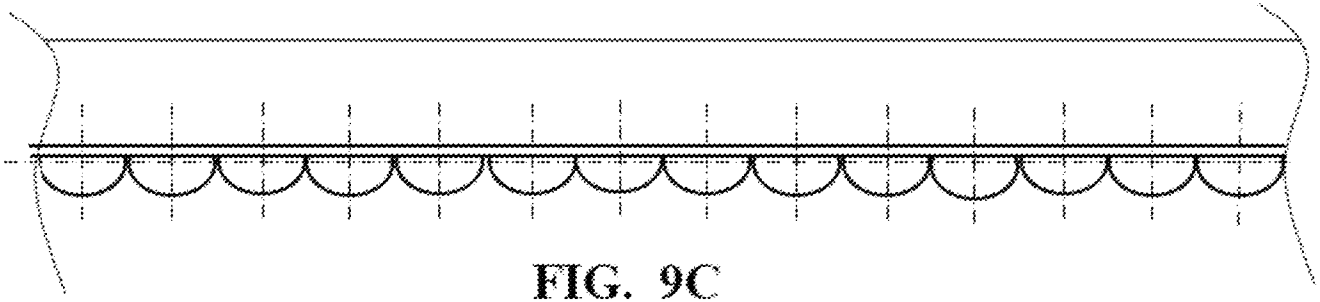
FIG. 9C shows serrations in the shape of half of a parabola.

FIGS. 9A-9C illustrate another structural option of the serrations on the inner surface at the edge of the spinning disk or bowl. The cross-section of a single serration is a half of a round circle as in FIG. 9A, or a half of an ellipse as in FIG. 9B, a half of a parabola as in FIG. 9C. The parameters define the serration structure are the length, L, the depth, D, and the spacing, d, where the ratio of L/D is about 20:1; d/D is about 1:1; with a spacing, d, about in the range of 200 μm to 500 μm.

Figure 10A:
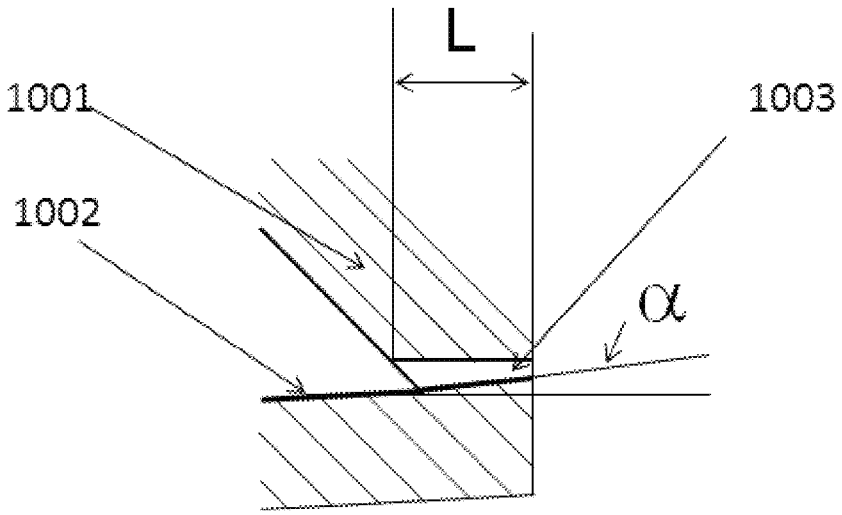
FIG. 10A is the cross-section view in radial direction of the spin disk or bowl of a channel of a spin orifice.
Figure 10B:
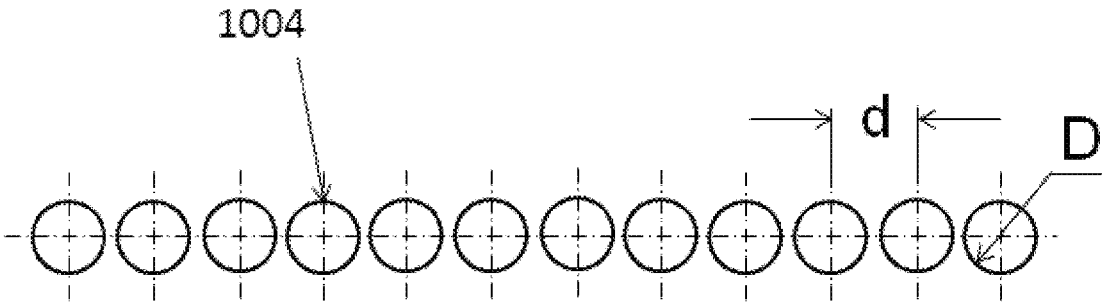
FIG. 10B is the cross-section view along the edge of the spin disk or bowl of the spin orifices.

FIG. 10 illustrates another structure of the edge of the spin disk or bowl with the side holes (spin orifices), as the multiple nozzles disk or bowl. The usefulness of the spin orifices on the side of a rotating member is known in the prior art in fiber spinning. The fiber spinning was from the bulk polymer through the spin orifices in the prior art and U.S. Pat. No. 8,231,378 B2. The nanofiber spinning was from the sheared thin film flow on the rotating disk or bowl inner surface before through the spin orifices in the present invention. In FIG. 10A, the spin orifices 1003 form the channels at the edge of the spin disk or bowl 1001. The inner entrances of the spin orifices contact and connect the inner surface 1002 of the spinning disk or bowl. In FIG. 10B, the parameters define the spin orifices structure are the length, L, the entrance diameter, D, and the spacing, d, where the ratio of L/D is about 20:1; d/D is about 1.5:1; with a spacing, d, about in the range of 200 μm to 500 μm. There is an inclining angle, a about from 0 to 15 degree, at the edge of the spinning disk, which also defines the gradual decreasing in diameter of the cross-section of the spin orifices.

Figure 11A:
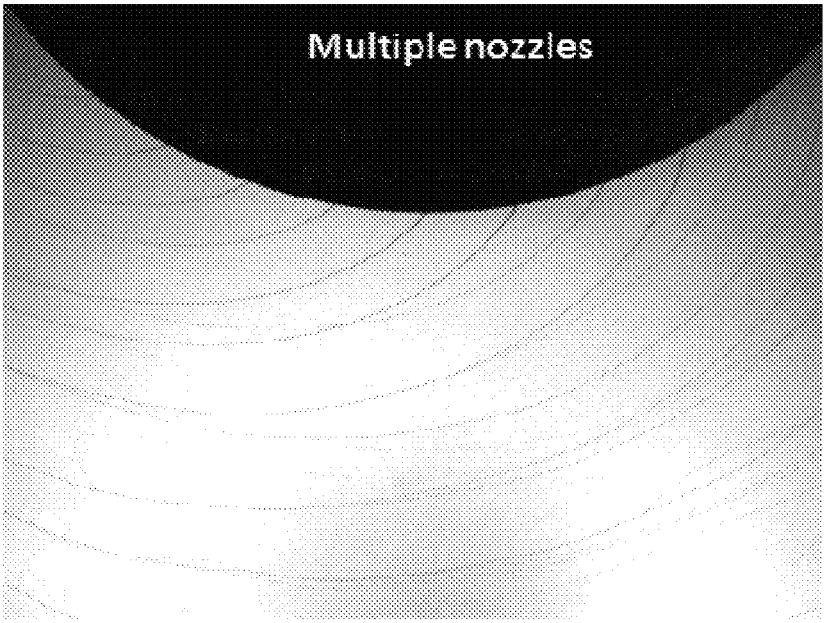
FIG. 11A shows the high-speed video image of the top view of the nanofiber formation from multiple nozzles disk.
Figure 11B:
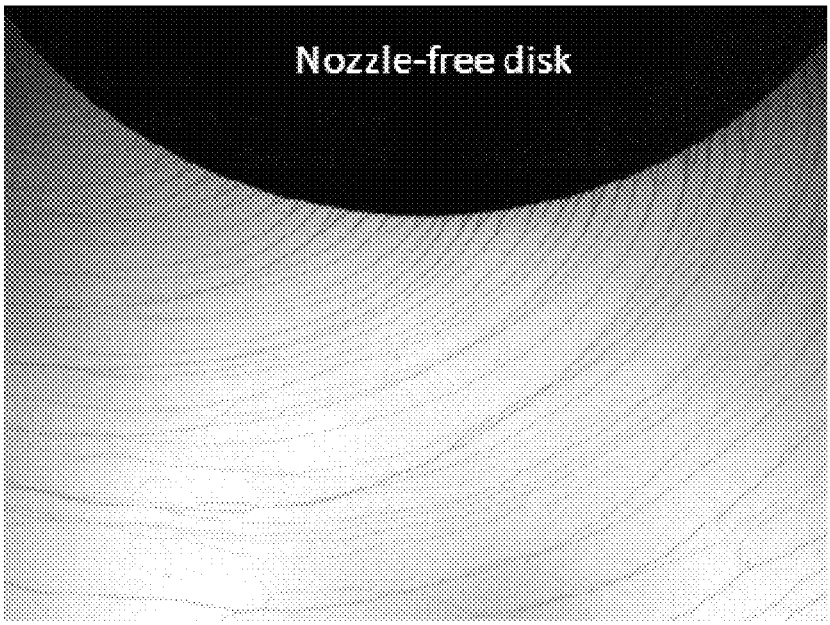
FIG. 11B shows the high-speed video image of the top view of the nanofiber formation from nozzle-free disk.

In comparison with the nozzle-free spin disk or bowl, the spin disk or bowl with multiple nozzles will have less throughput and relatively larger average fiber diameter under the same operation condition, as shown as in FIGS. 11A and 11B, respectively, of the high-speed video images.

Figure 12:
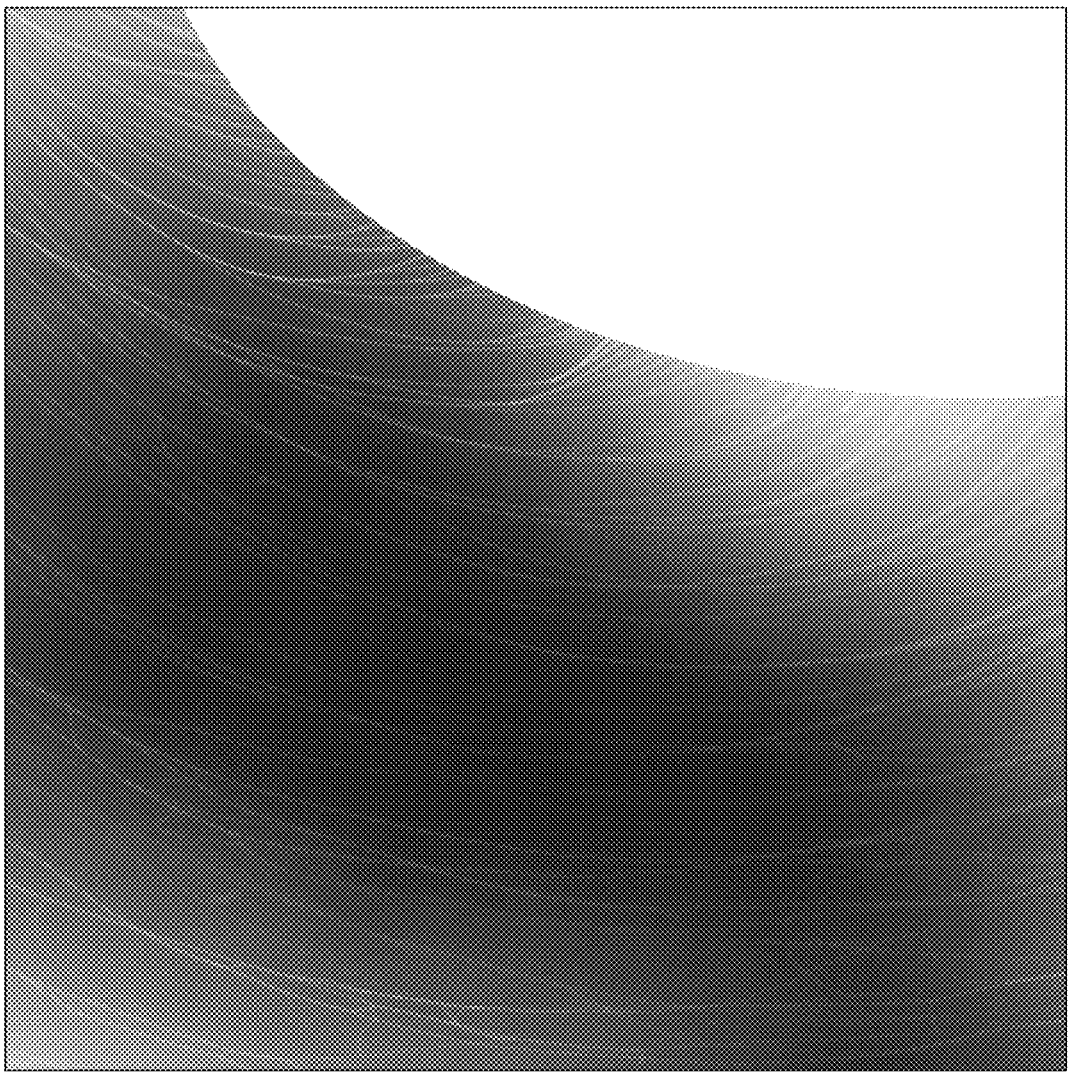
FIG. 12 shows the high-speed video image of the top view of the nanofiber formation and spinning.

The spin disk or spin bowl with the enclosed serrations produces the more uniform fibrillation, the better heating with the lower heating setting point, and the reduction or the elimination of the defects. FIG. 12 shows the top view of the high-speed video image from the spin disk the enclosed serrations in the present invention. In comparison with FIG. 3 from the open-end spin disk of U.S. Pat. No. 8,277,711 B2, the spin disk with the enclosed serrations will produce relatively smaller average fiber diameter under the same operation condition. By suppressing the film instability at the edge of the spinning disk, the spin disk with the enclosed serrations will eliminate the defects, such as, the microparticles, the powders, the tadpoles, the spatters and less numbers of the fiber bundles in the web.

Figure 13:
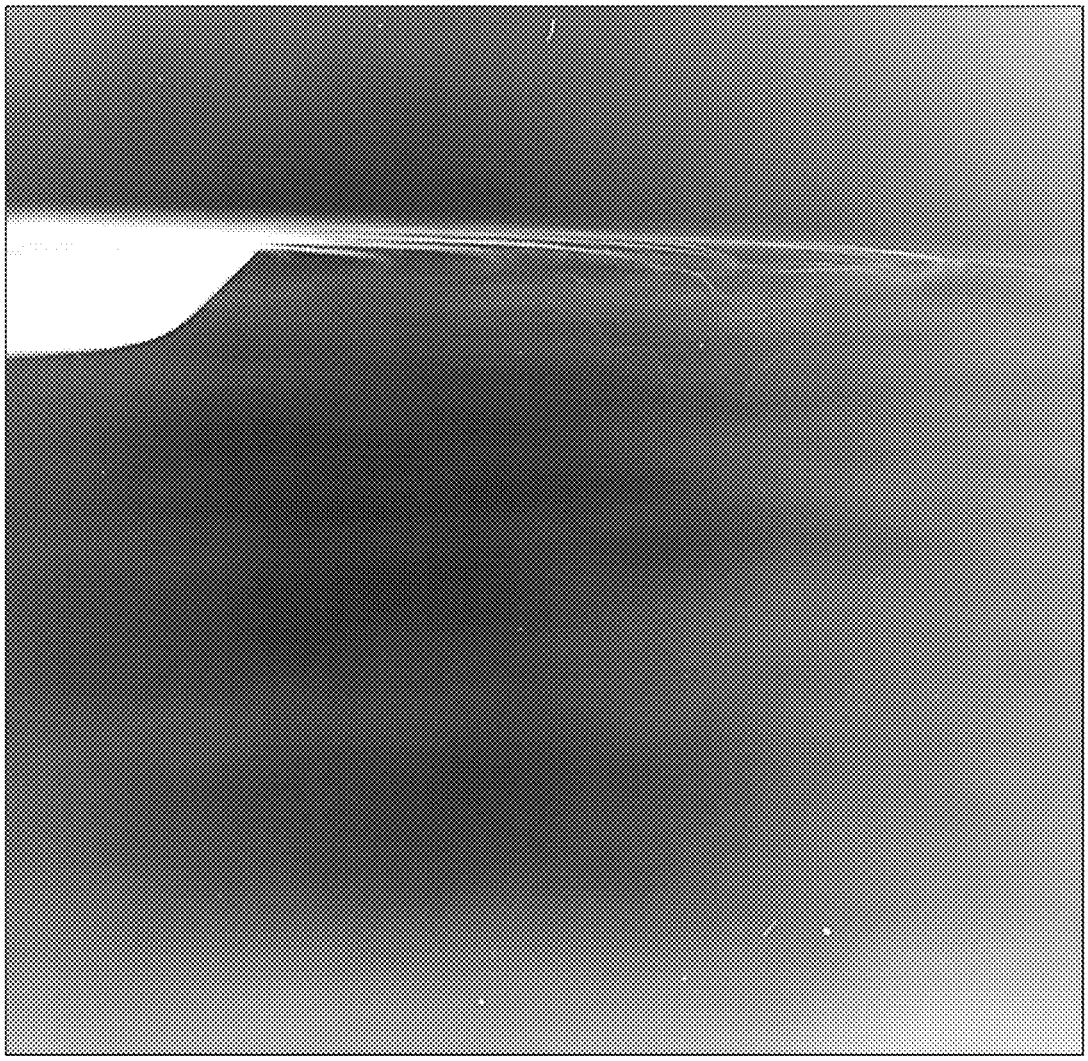
FIG. 13 shows the high-speed video image of the side view of the nanofiber formation and spinning.

The high-speed video image of FIG. 13 is the side view of the fiber spinning from the spin disk the enclosed serrations and the stationary shield in the present invention. The fibers are spinning down circularly with the very well delayed whipping instability. There is no "tornado-like" fiber stream under the spinning disk and above the surface of the web laydown collector.

Considering the polymer thin film flow on the inner surface of the rotating disk, the film thickness, h, the polymer flow can be expressed using the power-law fluid approximation as:

$$\tau = K|\gamma|^{n-1}\gamma$$

Where $\tau$ is the tangential shear stress, $\gamma$ is the shear rate, K is the coefficient of the consistency, n is the flow index, then, the film thickness is (REFFERENCE: O. K. Matar, G. M. Sisoev, and C. J. Lawrence, "The Flow of Thin Film Over Spinning Disk", Canadian Journal of Chemical Engineering, 84, December 2006):

$$h = \left[\frac{2n+1}{2\pi n}\right]^{\frac{n}{2n+1}} Q^{\frac{n}{2n+1}} r^{\frac{n+1}{2n+1}} \left(\frac{\rho\Omega^2}{K}\right)^{\frac{1}{2n+1}}$$

and the film velocity in thickness direction is:

$$Vz(r) = \left[\frac{n}{n+1}\right]\left(\frac{\rho\Omega^2 r}{K}\right)^{1/n}\left[h^{\frac{n+1}{n}} - (h-z)^{\frac{n+1}{n}}\right]$$

Then, the shear rate $\dot{\gamma}$ applied to the polymer thin film on the inner surface of the rotating disk can be expressed as:

$$\dot{\gamma} = \frac{\partial Vz(r)}{\partial z} = \left(\frac{\rho\Omega^2 rh}{\eta_0}\lambda^{1-n}\right)^{1/n}$$

Where, $\Omega$ is the rotating speed, Q is the melt feeding rate, $\eta_0$ is the viscosity of the polymer melt, r is the disk radius, $\rho$ is the melt density, $\lambda$ is a collection of parameters.

Figure 14:
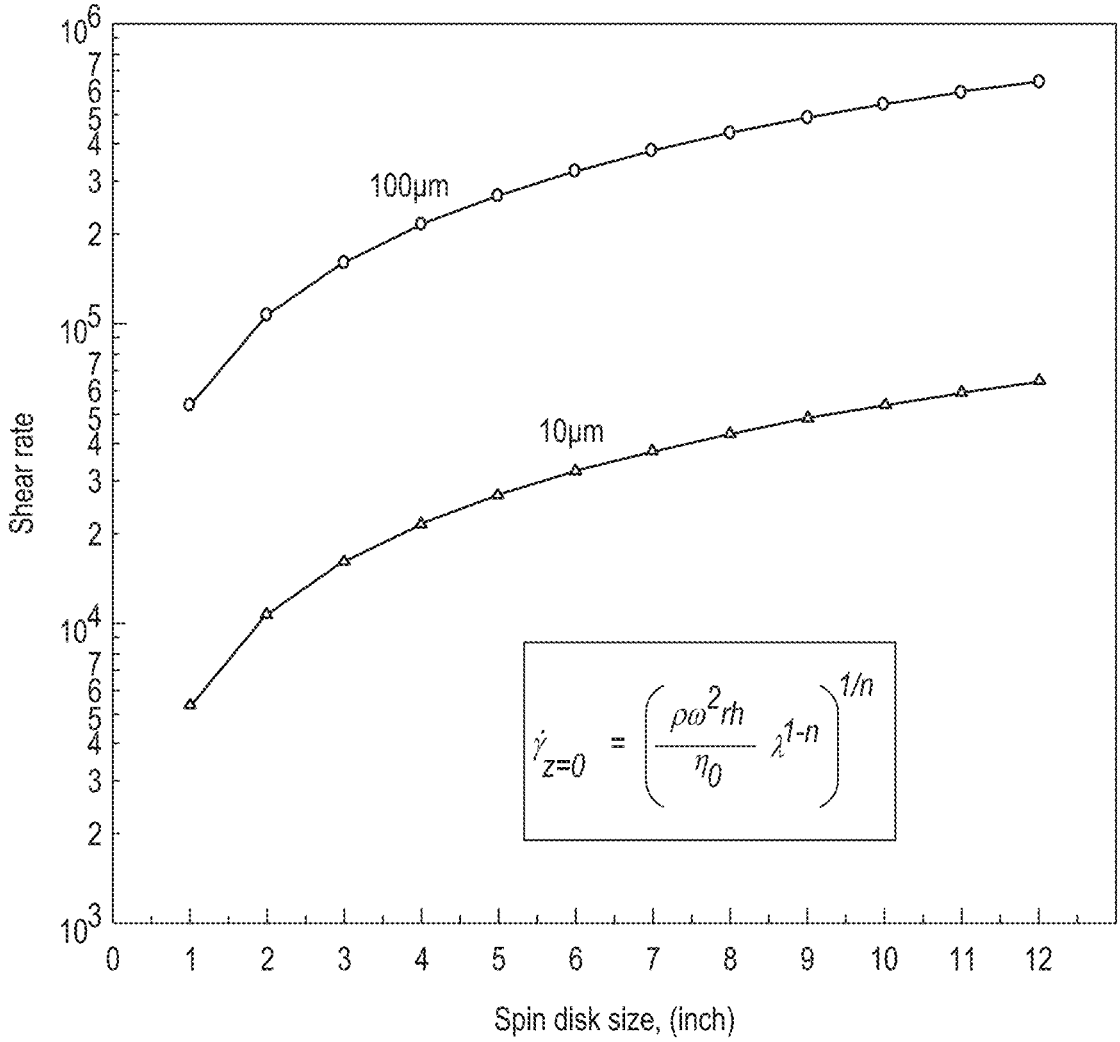
FIG. 14 is a chart of the shear rate applied to the thin film flow on the inner surface of the spin disk as the function of the spin disk size.
Figure 15:
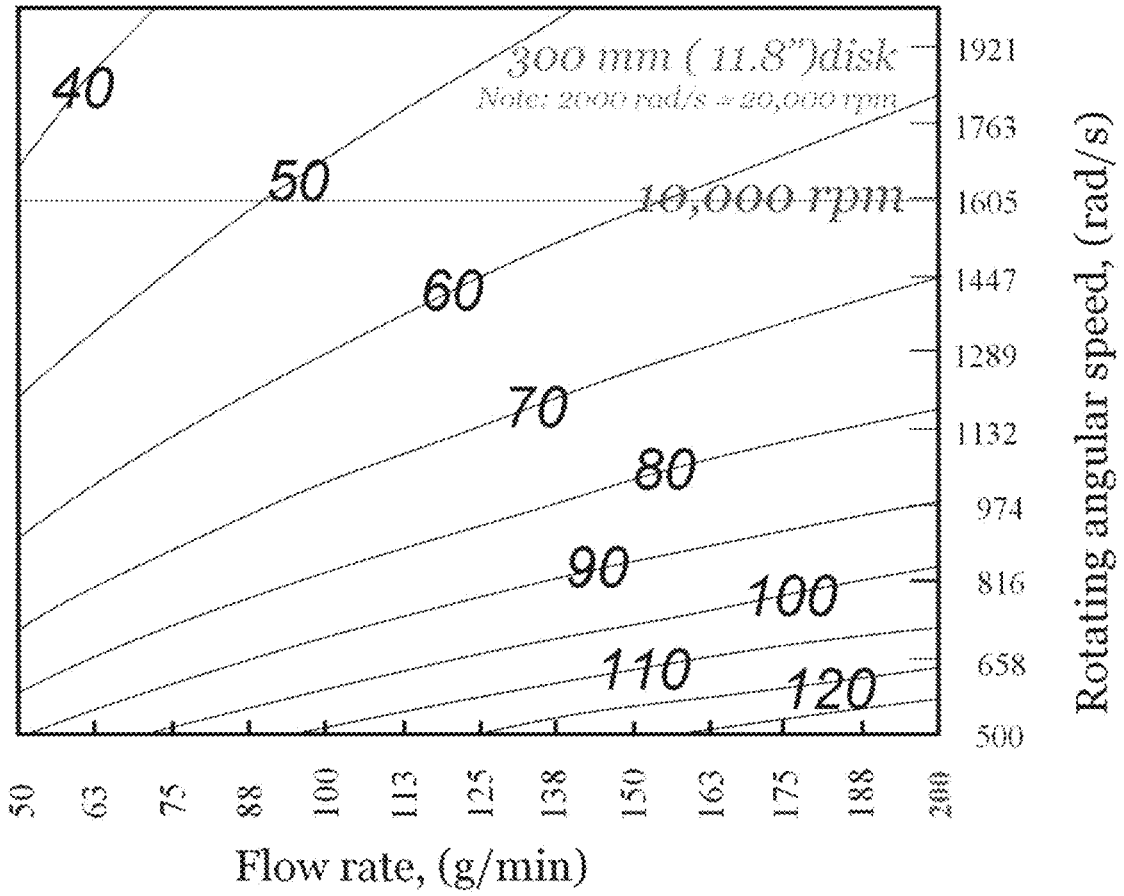
FIG. 15 is a chart of the thickness of the thin film flow on the inner surface of the spin disk as the function of the feeding rate and disk rotating speed.

FIG. 14 shows the shear rate applied to the thin film as a function of the spin disk size at rotational speed $\Omega$=10,000 rpm. For the thin film thickness of the range of 10 μm to 100 μm on the disk diameter up to 12 inches (about 300 mm), the shear rate applied to the thin film is in the range of $10^4$ to $10^6$ $\text{second}^{-1}$. This makes the distinguished feature of the process of U.S. Pat. No. 8,277,711 B2 comparing with other centrifugal fiber spinning process from the bulk of polymer melt. In order to estimate the throughput (or the productivity) of the process, FIG. 15 shows the relationship of the flow rate feeding to the spinning disk as function of the rotating speed respectively to the thin film thicknesses for a 300 mm disk. At the rotating speed of 10,000 rpm, the flow rate is about 200 g/min with the thin film thickness about to 50 μm to 60 μm. For a 150 mm disk, nanofibrous webs have been made from polypropylene under the melt feeding rate of 60 g/min/disk and 10,000 rpm.

Figure 16A:
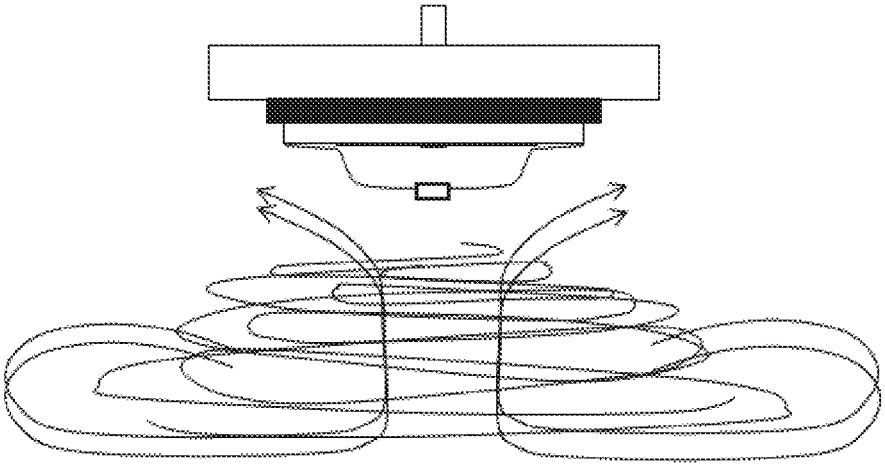
FIG. 16A illustrates the "tornado"-like phenomena when the laydown without any electrostatic charging and air flow management.
Figure 16B:
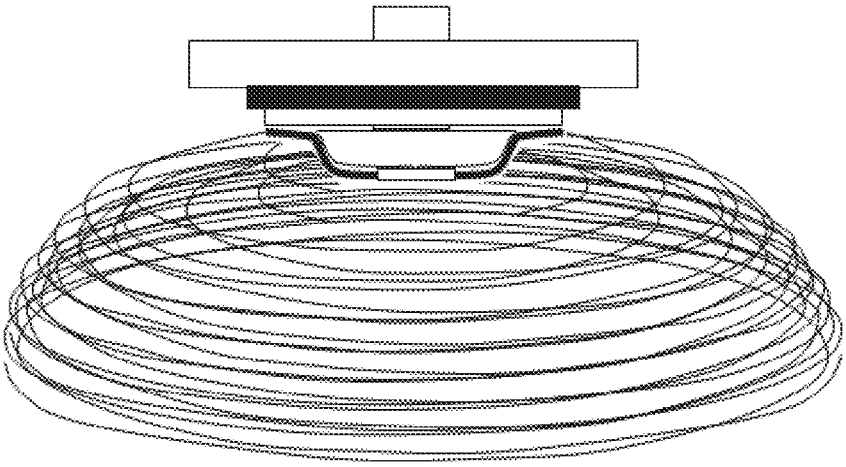
FIG. 16B illustrates the laydown case without the "tornado"-like phenomena with using the stationary shield under the spinning disk.

The web laydown of the nanofiber from centrifugal spinning process is another difficult issue. FIG. 16A illustrates the "tornado"-like phenomena when the laydown without any electrostatic charging and air flow management. FIG. 16B illustrates the laydown case without the "tornado"-like phenomena with using the stationary shield under the spinning disk in the present invention.

According to the present invention, the spinning melt comprises at least one polymer. Any melt spinnable, fiber-forming polymer can be used. Suitable polymers include thermoplastic materials comprising polyolefins, such as polyethylene polymers and copolymers, polypropylene polymers and copolymers; polyesters and co-polyesters, such as poly(ethylene terephthalate), biopolyesters, thermotropic liquid crystal polymers and PET copolyesters; polyamides (nylons); polyaramids; polycarbonates; acrylics and meth-acrylics, such as poly(meth)acrylates; polystyrene-based polymers and copolymers; cellulose esters; thermoplastic cellulose; cellulosics; acrylonitrile-butadiene-styrene (ABS) resins; acetals; chlorinated polyethers; fluoropolymers, such as polychlorotrifluoroethylenes (CTFE), fluorinated-ethylene-propylene (FEP); and polyvinylidene fluoride (PVDF); vinyls; biodegradable polymers, bio-based polymers, bi-composite engineering polymers and blends; embedded nanocomposites; natural polymers; and combinations thereof.

This invention is directed toward a spinning apparatus for making polymeric nanofibers, comprising: (a) a high speed rotating member comprising a spinning disk or a spinning bowl wherein the rotating member has an edge and, optionally, the rotating member can be heated by induction heating; (b) a protecting shield affixed to the edge of the rotating member to form enclosed serrations wherein the protecting shield is positioned on the top of the spinning disk or the bottom of the spinning bowl; (c) a stationary shield on the bottom of the rotating member; and (d) an optional stretching zone.

This invention is further directed toward polymeric nanofibers produced from this spinning apparatus wherein the polymeric nanofibers comprise at least about 99% by number of nanofibers with a number average diameter less than about 500 nm.

This invention is still further directed toward a nanofibrous web produced from these polymeric nanofibers wherein the nanofibrous web has: (a) less than about 5% Mw reduction of the nanofibrous web as compared to the polymer used for making the nanofibrous web; (b) essentially the same thermal weight loss as compared to the polymer used for making the nanofibrous web as measured by TGA; (c) higher crystallinity of the nanofibrous web as compared to the polymer used for making the nanofibrous web; and (d) average web strength of at least about 2.5 N/cm.

Test Methods

High-speed video image: In order to visualize the filming and fiber spinning, high-speed video image has been used for observing the spinning of poly(ethylene oxide) (PEO) in water solutions. Weight percent solutions ranging between 0% and 12% of 300,000 Mw PEO, purchased from Sigma-Aldrich, were prepared in deionized water. A Harvard apparatus PHD2000 Infusion syringe pump was used to control the flow rate of solution to a rotating geometry spinning between 1,000 and 30,000 RPM. Flow rates examined range between 0.01 to 50.00 mL/min. Two Photon FASTCAM SA5 model 1300K-M3 high speed video cameras with Canon 100 mm Macro lenses were used to capture the images included in this case with one camera positioned parallel and one camera positioned perpendicular to the spinning geometry. The camera and lens settings were chosen to maximize clarity at 7,000 fps, shudder speeds ranging between 0.37 and 4.64 μs, and apertures between f2.8 and f32.

Thermal analysis: In order to study the thermal degradation and crystallinity, thermal analysis was conducted using TA Instruments a Q2000 series differential scanning calorimeter (DSC) and a Q500 series thermo gravimetric analyzer (TGA). DSC samples underwent a standard heating, cooling, re-heating cycle from room temperature to 250° C. at 10° C./min under nitrogen. TGA samples underwent a standard ramp heat from room temperature to 900° C. at 10° C./min under nitrogen. TA Instruments Universal Analysis 2000 was used to analyze thermal data. The percent crystallinity of samples was determined using the accepted value for the enthalpy of fusion for 100% crystalline polypropylene equaling 207 J/g. (REFERENCE: A van der Wal, J. J Mulder, R. J Gaymans. Fracture of polypropylene: The effect of crystallinity. Polymer, Volume 39, Issue 22, October 1998, Pages 5477-5481)

Measurement of Molecular Weight: Molecular weight for polyolefin resins was measured by using high temperature size exclusion chromatography (SEC). This method includes the use of multi-angle light scattering and viscosity detectors in trichlorobenzene (TCB) at 150° C. The instruments used include a Polymer Laboratories PL220 liquid chromatograph instrument, with solvent delivery and autoinjector, and a Wyatt Technologies Dawn HELEOS multi-angle light scattering detector (MALS). The Polymer Laboratories SEC includes an internal differential viscometer and differential refractometer. Four Polymer Laboratories mixed B SEC columns were used for the separations. The sample injection volume was 200 microliters with a flow rate of 0.5 mL/min. The sample compartment, columns, internal detectors, transfer line, and Wyatt MALS were held at a controlled temperature between 150 and 160° C. depending on the polymer. After the solution passes through the columns within the Polymer Laboratories SEC, the flow was directed out of the instrument and through a heated transfer line to the Wyatt MALS before being returned back to the Polymer Laboratories SEC. The data recovered from the instrumentation was analyzed using Wyatt Technologies Astra software. The concentration was calculated using a dn/dc of 0.092 for polyolefin in TCB. Molecular weights were calculated from the light scattering intensities rather than elution time, and are not relative to standards. In order to ensure instrument performance and accuracy, available NIST polyethylene standards are periodically analyzed.

Measurement of Web Strength: Tensile strength and elongation of nanofibrous web samples were measured using an INSTRON tensile tester model 1122, according to ASTM D5035-11, "Standard Test Method for Breaking Force and Elongation of Textile Fabrics (Strip Method)" with modified sample dimensions and strain rate. Gauge length of each sample is 2 inches with 0.5 in. width. Crosshead speed is 1 inch/min (a constant strain rate of 50% $min^{-1}$). Samples are tested in the "Machine Direction" (MD) as well as in the "Transverse Direction" (TD). A minimum of 3 specimens are tested to obtain the mean value for tensile strength or elongation.

SEM: Scanning Electron Microscope (SEM) image was used dominantly in nanofiber characterization because it delivers superb image clarity at high magnification and has become the industry standard for measuring nanofiber diameter. The differences of nanofiber morphology in high magnification SEM images with ×5,000 or ×10,000 of nanofibrous webs produced from different nanofiber processes are difficult to be distinguished beside the fiber diameter. In order to reveal the fiber morphology in different levels of details, the SEM images were taken at ×25, ×100, ×250, ×500, ×1,000, ×2,500, ×5,000 and ×10,000.

EXAMPLES

In principle, a nanofibrous web media consisting of continuous fibers were made using the centrifugal melt spin process of U.S. Pat. No. 8,277,711. Examples in this invention were made by incorporating improved elements, such as, the enclosed serrations and the optimized serration structures at the edge of the spinning disk or the spinning bowl, the stretching zone and its temperature, the stationary shield under the spinning disk or the spinning bowl. The Comparative Examples were made by using the open-end spin disk of the centrifugal melt spin process of U.S. Pat. No. 8,277,711 B2. The other comparative example made by the force spinning process of U.S. Pat. No. 8,231,378 B2 was received from FibeRio Company.

Example 1

Continuous fibers were made by a spin disk with the enclosed serrations and the stationary shield using an apparatus as illustrated in FIG. 1, from a polypropylene (PP) homopolymer, Metocene MF650Y from LyondellBasell. It has Mw=75,381 g/mol, melt flow rate=1800 g/10 min (230° C./2.16 kg), and zero shear viscosity of 9.07 Pa·S at 200° C. A PRISM extruder with a gear pump was used to deliver the polymer melt to the rotating spin bowl through melt transfer line. The temperature of the spinning melt from the melt transfer line was set to 240° C. The temperature of spin disk edge was about 200° C. The stretching zone heating air was set at 200° C. The stretching zone air through the gap between the disk and the stationary shield was set at 200° C. with the air flow rate of 50 SCFH. The downward shaping air was set at 150° C. The shaping air flow was set at 50 SCFH. The rotation speed of the spin disk was set to a constant 12,000 rpm.

Figure 17A:
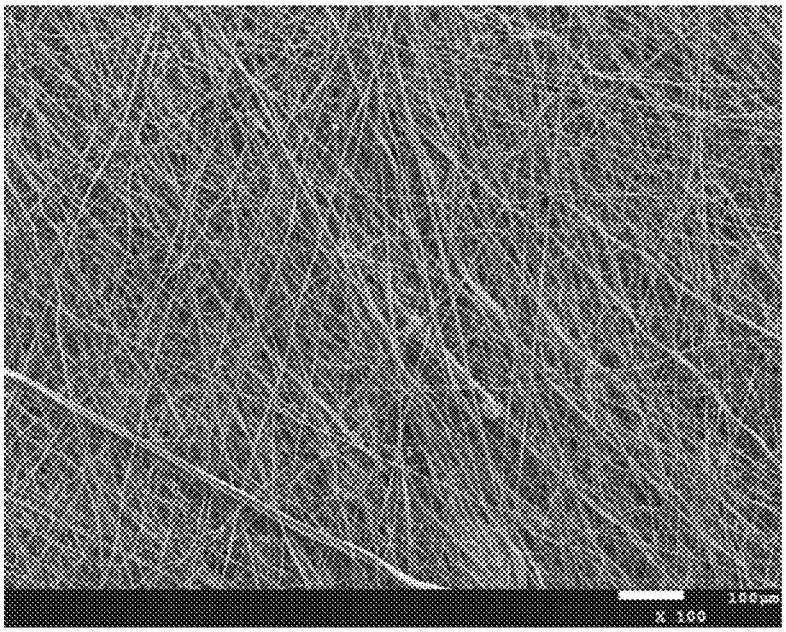
FIGS. 17A and 17B show SEM images of Example 1 at 100× and 2500× magnifications, respectively.
Figure 17B:
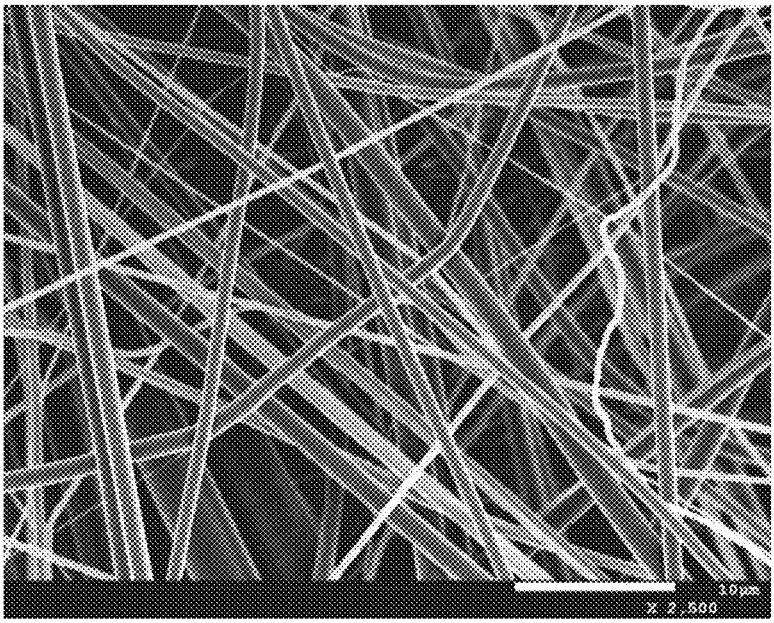

The fiber size was measured from an image using scanning electron microscopy (SEM) as shown as in FIGS. 17A and 17B. Example 1 has a fiber diameter mean and median for the total fibers measured of 523 nm and 504 nm from total counts of 154 individual nanofibers in the range of the minimum of 172 nm to the maximum of 997 nm.

Comparative Example 1

Continuous fibers were made by an open-end spin disk using the process of U.S. Pat. No. 8,277,711 B2, from the same polypropylene (PP) homopolymer used in Example 1. A PRISM extruder with a gear pump was used to deliver the polymer melt to the rotating spin disk through melt transfer line. The temperature of the spinning melt from the melt transfer line was set to 200° C. and the melt feeding rate was 18.14 gram/min. The temperature of spin disk edge was to be about 240° C. The stretching zone heating air was set at 250° C. The downward shaping air was set at 150° C. The shaping air flow was set at 15.0 SCFM. The rotation speed of the spin disk was set to a constant 10,000 rpm.

Figure 18A:
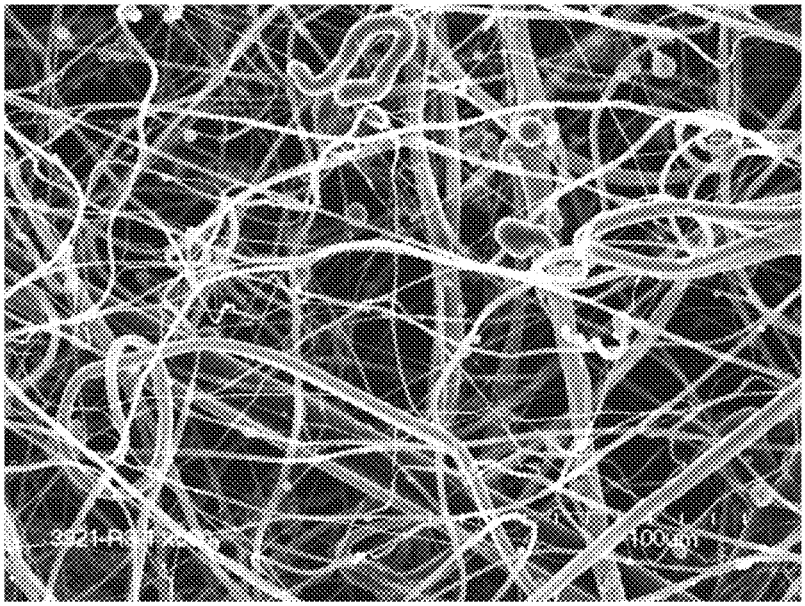
FIGS. 18A and 18B show SEM images of Comparative Example 1 with mixtures of nanofibers, microfibers, coarse fibers, micro-particles and the "spatters" defects at 500× and 2500× magnifications, respectively.
Figure 18B:
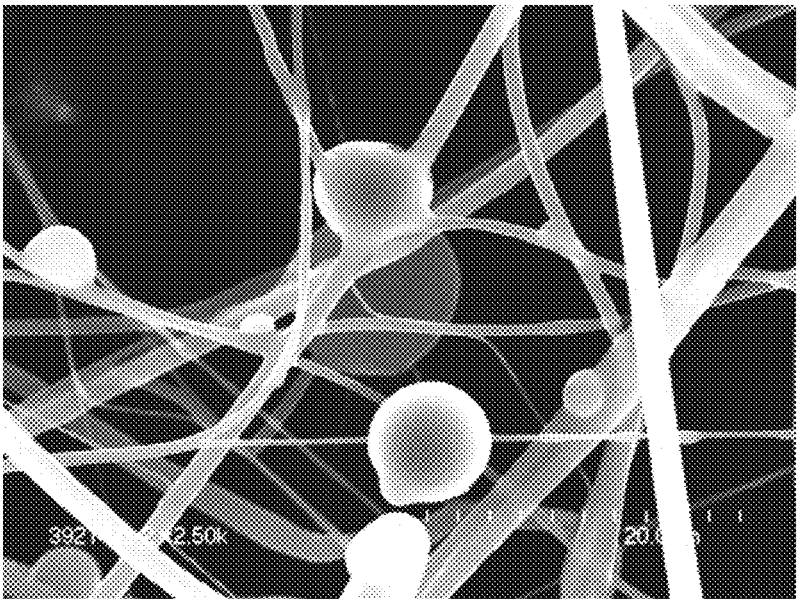

The fiber size was measured from an image using scanning electron microscopy (SEM) as shown as in FIGS. 18A and 18B. Comparative Example 1 has a fiber diameter mean and median for the total fibers measured of 685 nm and 433 nm from total counts of 583 individual nanofibers in the range of the minimum of 126 nm to the maximum of 8460 nm. There are about 83.88% nanofibers, 14.92% of microfibers and 1.2% coarse fibers. There are some "spatters" type defects with about 10 μm in diameter and micron-particles with about 1 μm to 5 μm in diameter.

Comparative Example 2

Continuous fibers were made by an open-end spin disk using the process of U.S. Pat. No. 8,277,711 B2, from the same polypropylene (PP) homopolymer used in Example 1. The temperature of the spinning melt from the melt transfer line to the rotating spin disk was set to 200° C. The temperature of spin bowl edge was about 240° C. The stretching zone heating air was set at 250° C. The downward shaping air was set at 150° C. The shaping air flow was set at 50.0 SCFH. The rotation speed of the spin disk was set to a constant 10,000 rpm.

Figure 19A:
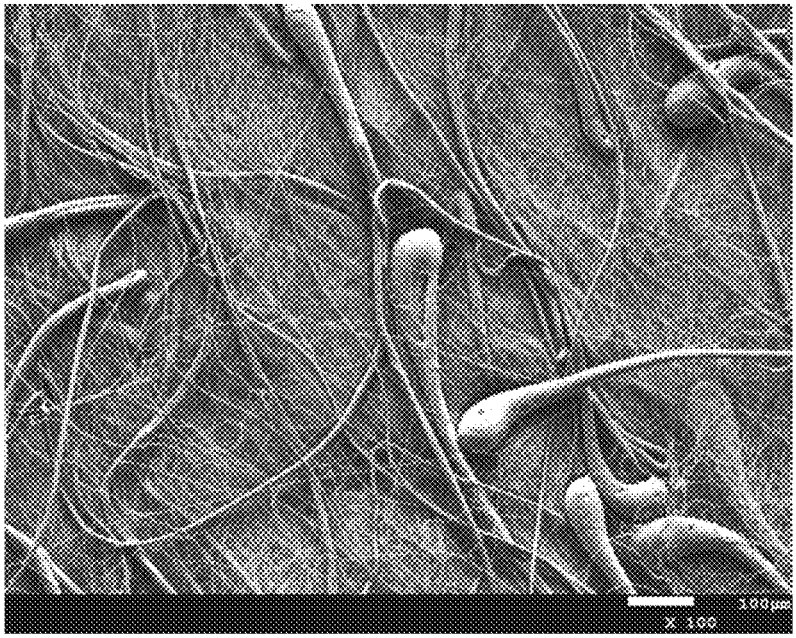
FIGS. 19A and 19B show SEM images of Comparative Example 2 with mixtures of nanofibers, microfibers, coarse fibers and the "tadpoles" defects at 100× and 250× magnifications, respectively.
Figure 19B:
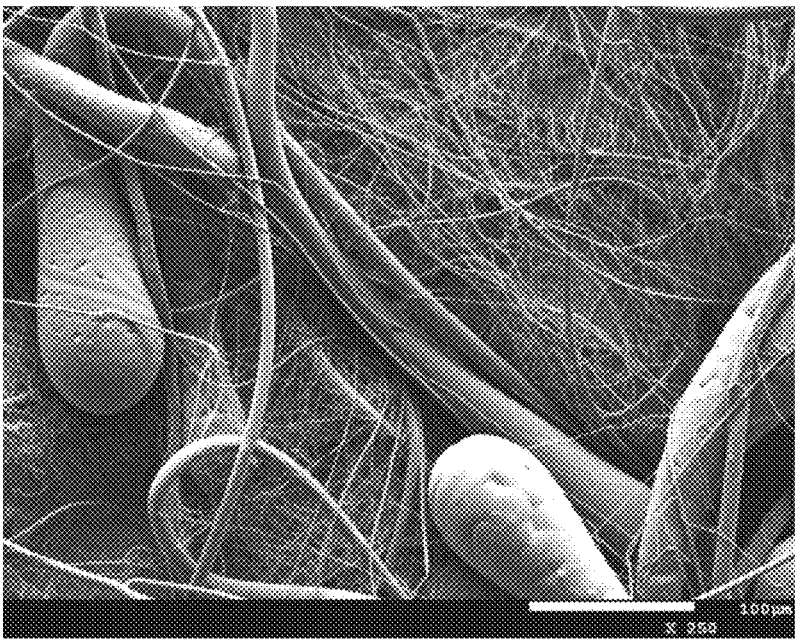
Figure 20:
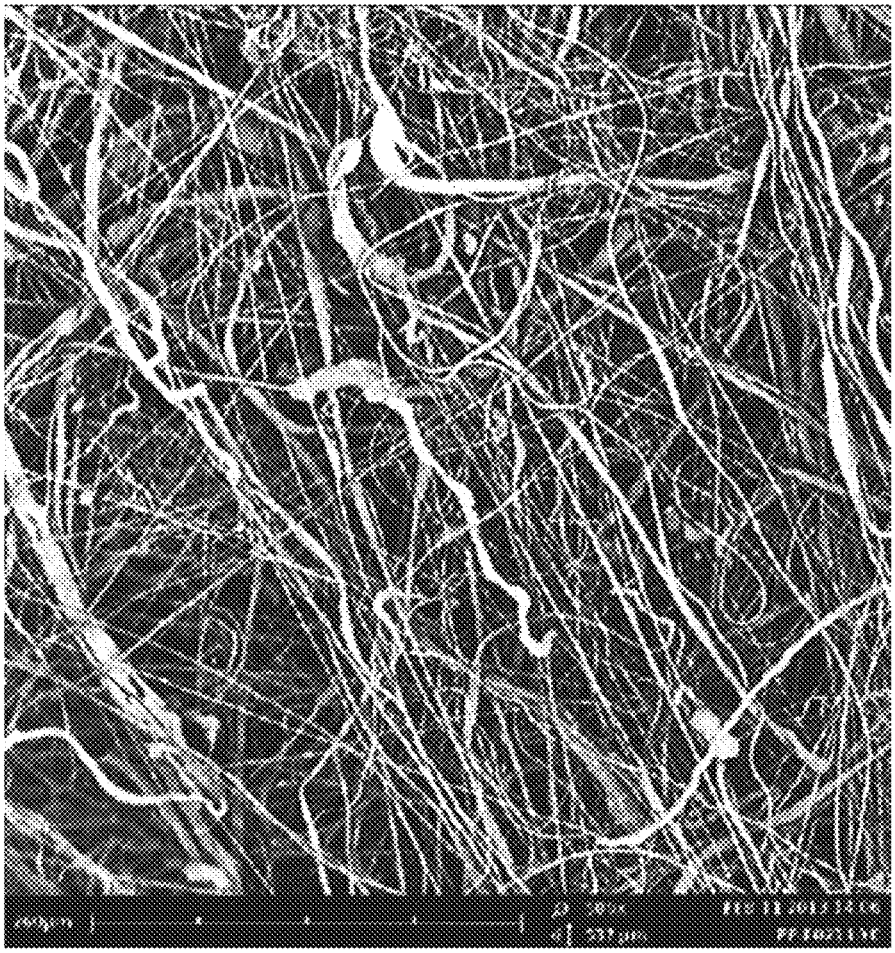
FIG. 20 shows SEM images of Comparative Example 3 with a mixture of nanofibers, microfibers, the curled coarse fibers and the "spatters" and "tadpoles" defects.

The fiber size was measured from an image using scanning electron microscopy (SEM) as shown as in FIGS. 19A and 19B. There are some "tadpoles" type defects with about head of about 60 μm in diameter and about 14,000 μm in length.

Comparative Example 3

Figure 25:
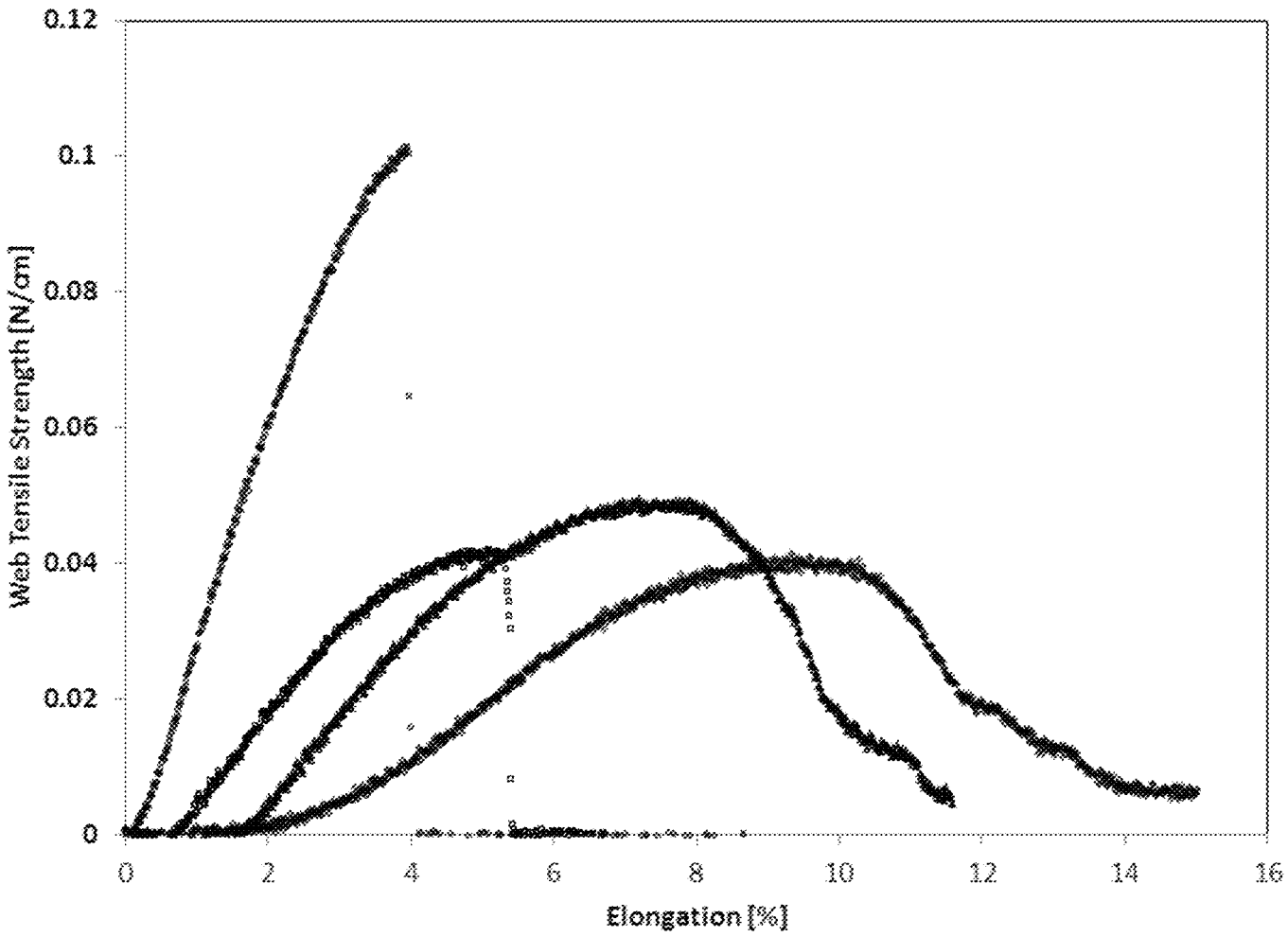
FIG. 25 shows the web strength measurement of the nanofibrous web of Comparative Example 3 from four different locations.

Comparative Example 3 along with SEM image and the fiber diameter distribution was received from FibeRio Company made by the Force spinning process of U.S. Pat. No. 8,231,378 B2. Comparative Example 3A is a 2.0 gsm of PP nanofibers on scrim sample. Comparative Example 3B is a 8.0 gsm of PP nanofibers sample taken off from scrim. The number average fiber diameter is 612 nm in a range of fibers from about 300 nm to 2400 nm. There are some "spatters" type defects and curled thick fibers. FIG. 25 shows the web strength measured from 4 different locations. It shows the maximum web strength of 0.1 N/cm and the maximum web elongation of 14%.

Figure 21:
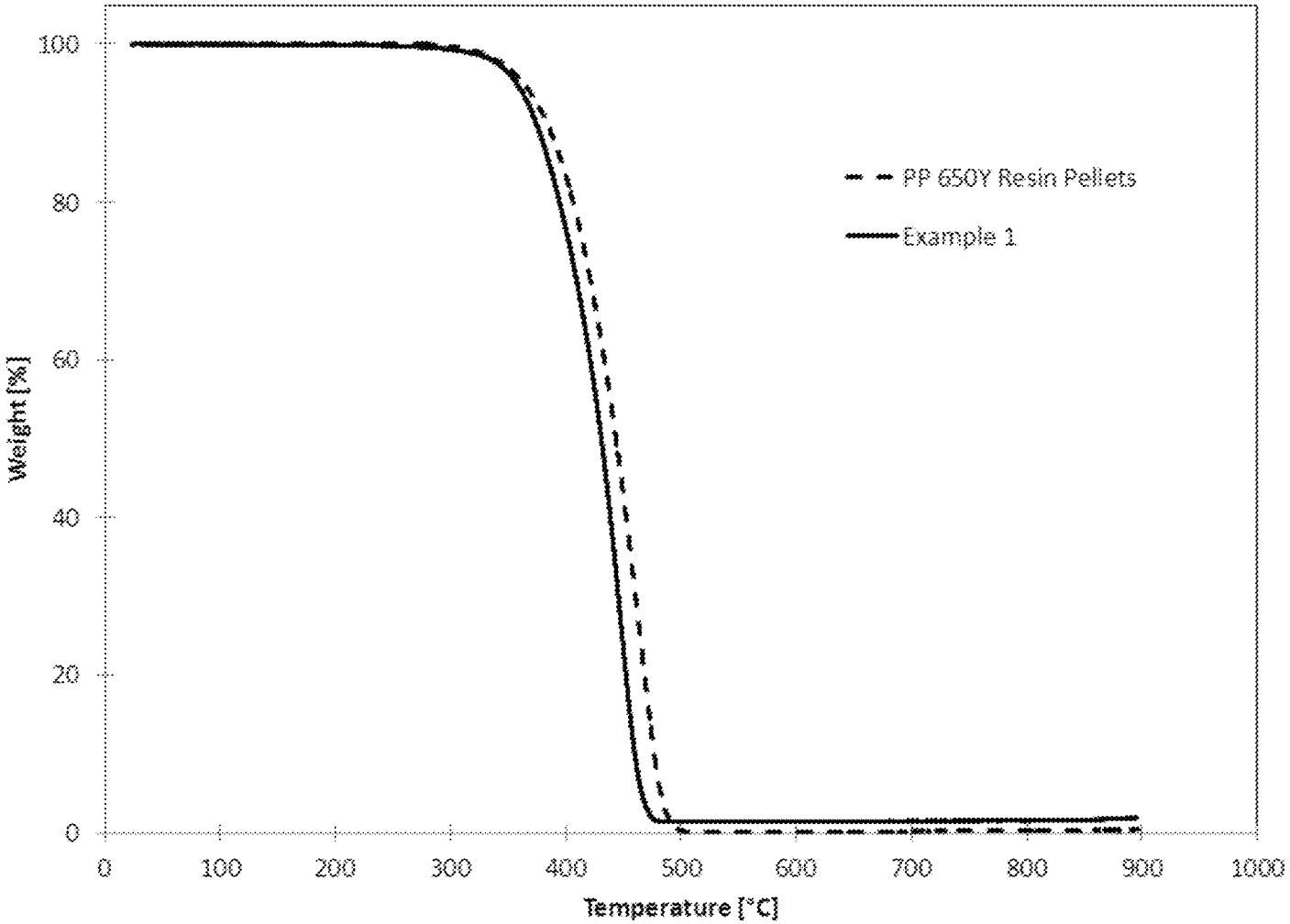
FIG. 21 shows the TGA measurement of the nanofibrous web of Example 1 and the polymer resin pellets used in making the web.
Figure 22:
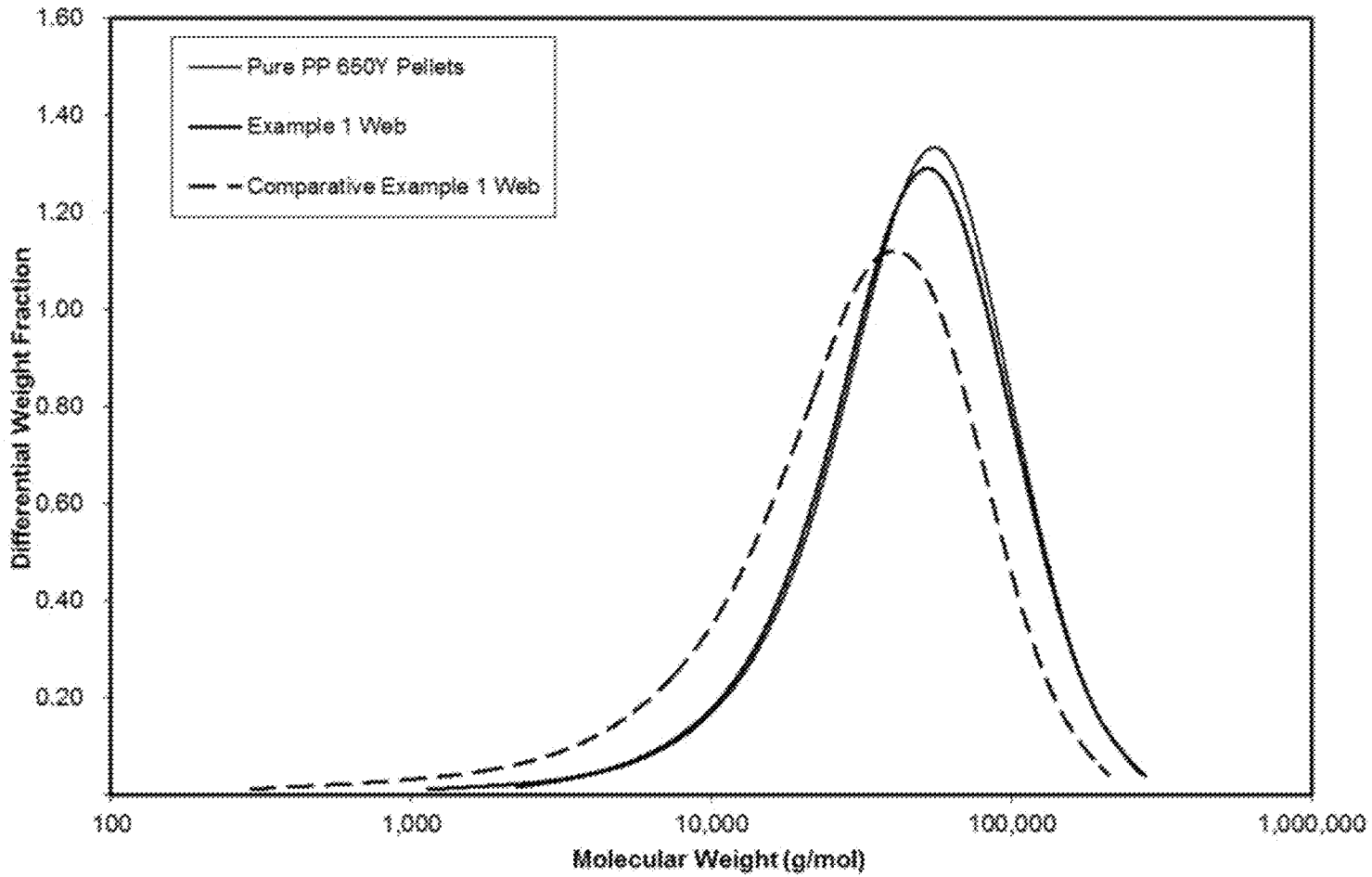
FIG. 22 shows the macromolecules weight measurement of the nanofibrous webs of Example 1 and Comparative Example 1, as well as the polymer resin pellets used in making the web.
Figure 23:
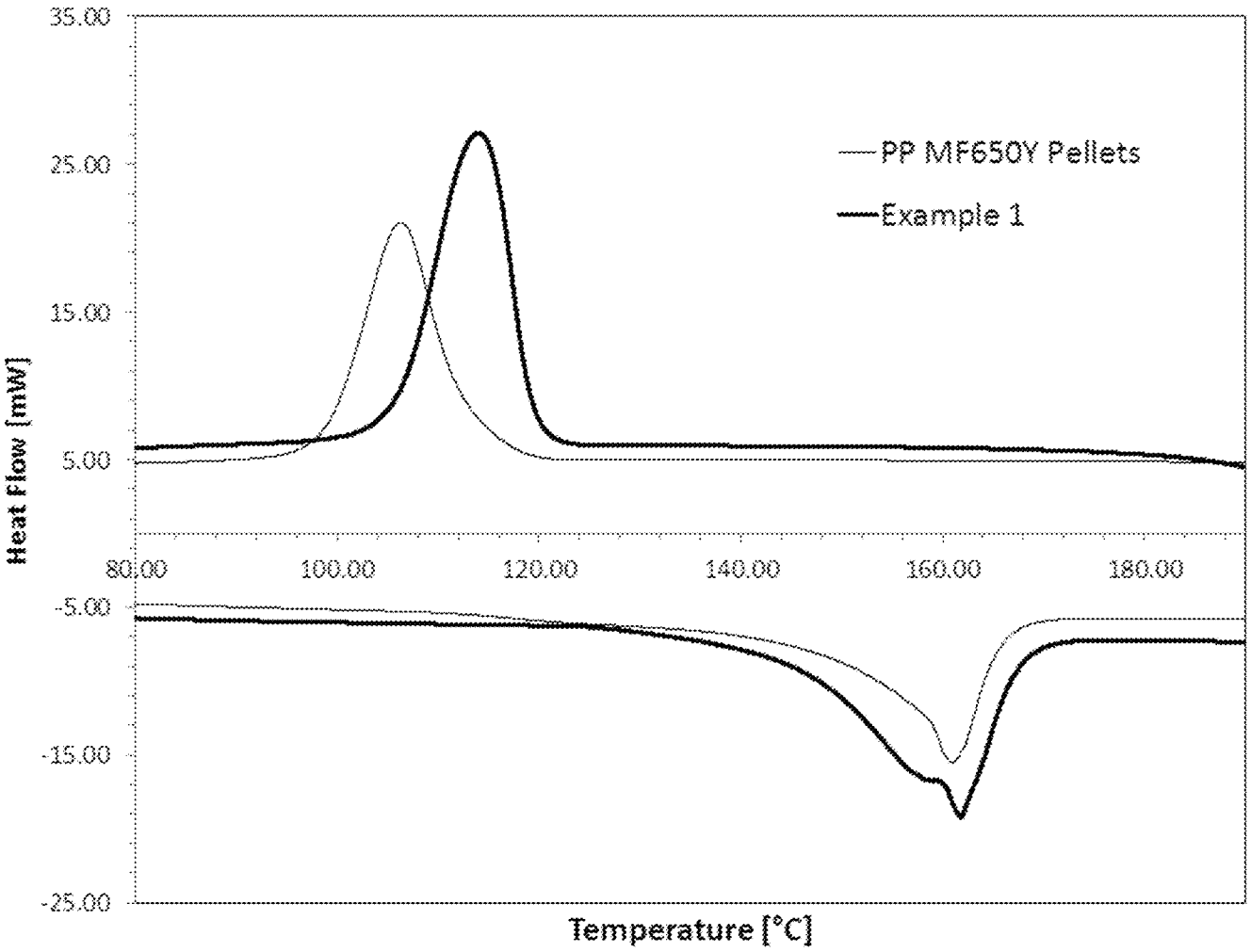
FIG. 23 shows the DSC measurement of the nanofibrous web of Example 1 and the polymer resin pellets used in making the web.
Figure 24:
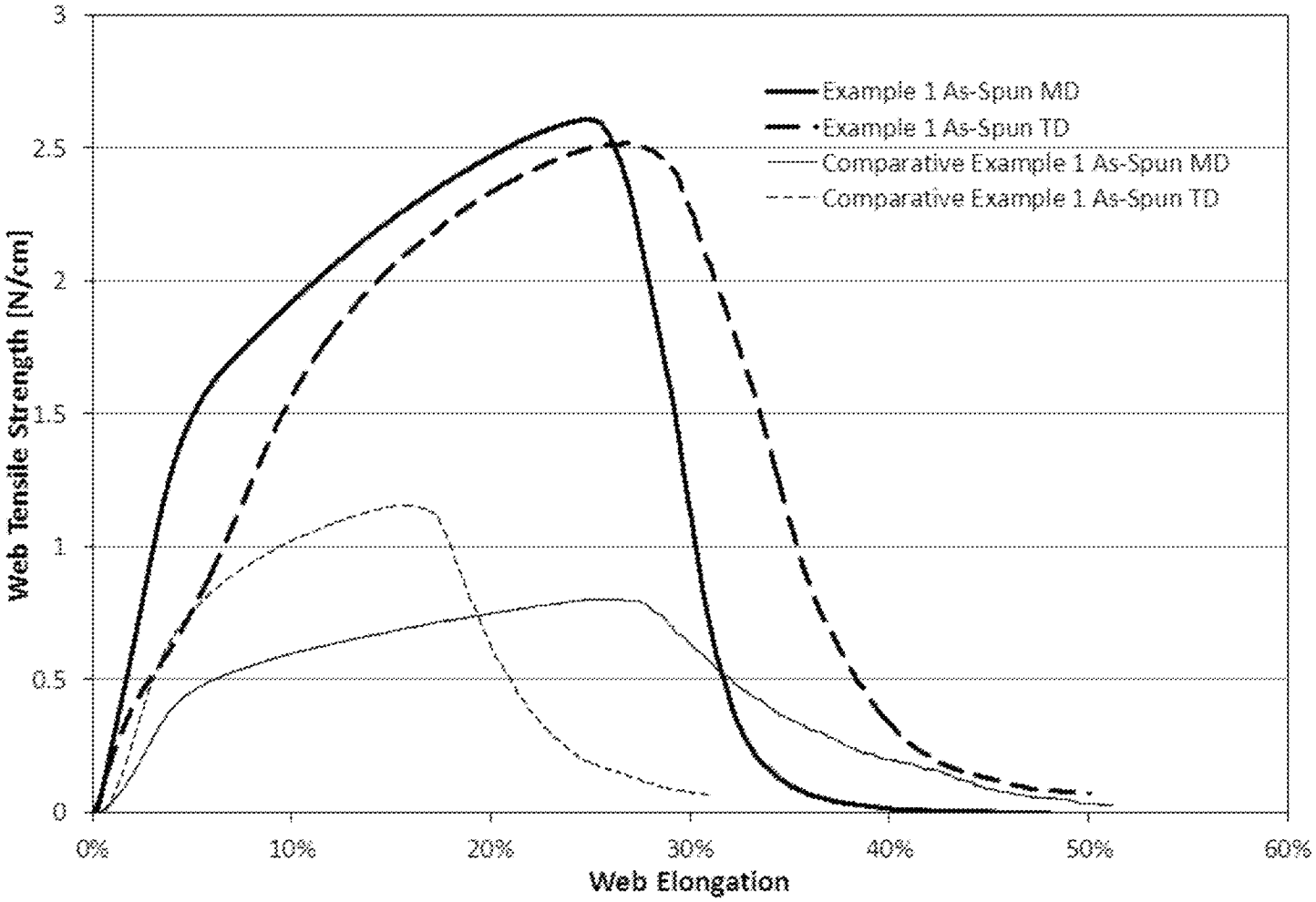
FIG. 24 shows the average web strength measurement of the nanofibrous web of Example 1 and Comparative Example 1.

The defects-free nanofibrous web of Examples made using the improved centrifugal nanofiber spinning apparatus with the improvements in the present invention to the process of U.S. Pat. No. 8,277,711 B2. FIG. 21 shows the almost identical TGA measurement of the nanofibrous web of Example 1 and the polymer resin pellets used in making the web. FIG. 22 shows the macromolecules weight measurement of the nanofibrous webs of Example 1 and Comparative Example 1, as well as the polymer resin pellets used in making the web. There is small reduction of macromolecules weight in the nanofibrous webs of Example 1 comparing to the polymer resin pellets used in making the web. FIG. 23 shows the crystallinity of the nanofibrous web is higher than the polymer resin used for making nanofibers from the DSC measurement. Overall, the measurements show that the thermal degradation has been reduced to minimum. FIG. 24 shows that the average web strength measurement of the nanofibrous web of Example 1 is 2.5 times higher than the Comparative Example 1.

What is claimed is:

1. A nanofibrous web produced from polymeric nanofibers produced from a spinning apparatus for making polymeric nanofibers comprising:

(a) a high speed rotating member comprising a spinning disk or a spinning bowl, mounted on a rotating hollow shaft, wherein the rotating member has an edge, the edge having serrations thereon, and, optionally, the rotating member can be heated by induction heating;

(b) a protecting shield placed to contact the serrations on the edge of the rotating member to form enclosed serrations wherein the protecting shield is mounted on the top of the spinning disk or the bottom of the spinning bowl;

(c) a stationary shield on the bottom of the rotating member, mounted on a stationary shaft through the rotating hollow shaft; and (d) an optional stretching zone;

wherein the polymeric nanofibers comprise at least about 99% by number of nanofibers with a number average diameter less than about 500 nm;

wherein the nanofibrous web has:

(i) less than about 5% Mw reduction as compared to the polymer used for making the nanofibrous web;

(ii) essentially the same thermal weight loss as compared to the polymer used for making the nanofibrous web as measured by a thermo gravimetric analyzer;

(iii) higher crystallinity than the polymer used for making the nanofibrous web; and (iv) an average web strength of at least about 2.5 N/cm.

* * * * *